US005778300A

United States Patent [19]

Murakami et al.

[11] Patent Number: 5,778,300

[45] Date of Patent: Jul. 7, 1998

[54] SHEET PROCESSING DEVICE

[75] Inventors: Koichi Murakami, Yokohama; Shigeru Sugita, Sayama; Masaaki Sato, Kawasaki; Yoshinori Isobe; Norifumi Miyake, both of Tokyo; Hiromichi Tsujino, Yokohama, all of Japan

[73] Assignee: Canon Kabushiki Kaisha, Japan

[21] Appl. No.: 706,776

[22] Filed: Sep. 3, 1996

[30] Foreign Application Priority Data

Sep. 4, 1995 [JP] Japan ..... 7-248314

[51] Int. Cl.[6] ..... G03G 21/00

[52] U.S. Cl. ..... 399/403; 399/364; 399/410; 271/287

[58] Field of Search ..... 399/364, 401, 399/402, 403, 407, 410; 271/287, 290, 301; 270/58.01

[56] References Cited

U.S. PATENT DOCUMENTS 4,935,786 6/1990 Veeder .
5,101,241 3/1992 Watanabe .
5,546,168 8/1996 Adachi et al. .

*Primary Examiner*—R. L. Moses
*Attorney, Agent, or Firm*—Fitzpatrick, Cella, Harper & Scinto

[57] ABSTRACT

A sheet processing device which is mounted on an image forming apparatus having a both-side copy mode of forming an image on each side of a sheet member, including a bin module provided with a plurality of bins for accepting sheet members exhausted from the image forming apparatus, and a processor for taking out sheet members exhausted from the bin and processing the sheet members. When the maximum number of sheets continuously producible per unit in the both-side copy mode for the image forming apparatus is N, and the number of bins is m, the number of bins m is set to satisfy the following relational expression:

$m \geqq N$.

21 Claims, 35 Drawing Sheets

SHEET PROCESSING DEVICE

BACKGROUND OF THE INVENTION

1. Field of the Invention

The present invention relates to a sheet processing device for processing the sheet exhausted i.e., discharge, from an image forming apparatus having a both-side copy mode, and the image forming apparatus comprising the sheet processing device.

2. Related Background Art

In recent years, owing to the energy saving policies, the image forming apparatuses capable of operating a both-side copy mode, as well as a normal single-side copy mode, have spread. In this both-side copy mode, an original image is formed on one face of a sheet, the sheet is pulled into a reverse transport passage for reversing the image formation face of that sheet from one side to the other, and after reversal of the sheet face, an image is formed on the other face of the sheet, so that the sheet having the images formed on both sides is exhausted. Accordingly, in this both-side copy mode, since the sheet face is reversed, the amount of copies continuously processible in the both-side copy mode is less than that in the single-side copy mode.

Also, to reduce the labor required for the copy operation, an image forming apparatus is able to mount an automatic original feeder for automatically feeding the original, and a sheet member post-processor or a so-called sorter/finisher for selectively performing processes, including a sort process for page arranging or sorting the sheets on which original image is recorded, or a staple process for stapling a bundle consisting of a plurality of sheets with a staple.

This sheet member post-processor comprising sorter means for sorting the sheets exhausted and transported from the image forming apparatus along a transport passage into a plurality of bins with the movement of bins, a stapler for stapling the sheets classified into respective bins, and storing means for storing the sheets classified into the respective bins and taken out along the transport passage into a stack unit was disclosed (Japanese Patent Laid-Open Application No. 4-138291).

This sheet member post-processor involves once classifying the sheets exhausted from the image forming apparatus into the bins and then stapling the bundle.

However, the conventional sheet member post-processor, which once classifies the sheets exhausted from the image forming apparatus into the bins and then performs the stapling operation, can not process the exhausted sheets continuously, when the number of bins is less than the number of sheets consecutively exhausted from the image forming apparatus, that is, when the number of bins is smaller than the number of copies, whereby it is necessary to secure the processing time for processing the sheets exhausted from the image forming apparatus by interrupting the image forming operation of the image forming apparatus, e.g., by temporarily stopping the image forming apparatus to exhaust the sheet.

In particular, since the continuous processing amount in the both-side copy mode is less than that in the single copy mode, if the operation of the image forming apparatus is interrupted to secure the processing time for processing the sheets exhausted from the image forming apparatus, the processing amount of copies in the both-side copy mode is further decreased, resulting in remarkably reduced productivity.

SUMMARY OF THE INVENTION

An object of the present invention is to provide a sheet processing device for which the above-mentioned problem has been solved.

It is another object of the invention to provide a sheet processing device which can eliminate the interrupted operation of an image forming apparatus caused to secure the processing time of sheet members exhausted in a both-side copy mode, and prevent the decreased productivity in the both-side copy mode of the image forming apparatus.

Other objects and features of the present invention will be apparent from the following description and the accompanying drawings.

DETAILED DESCRIPTION OF PREFERRED EMBODIMENTS

Figure 1:
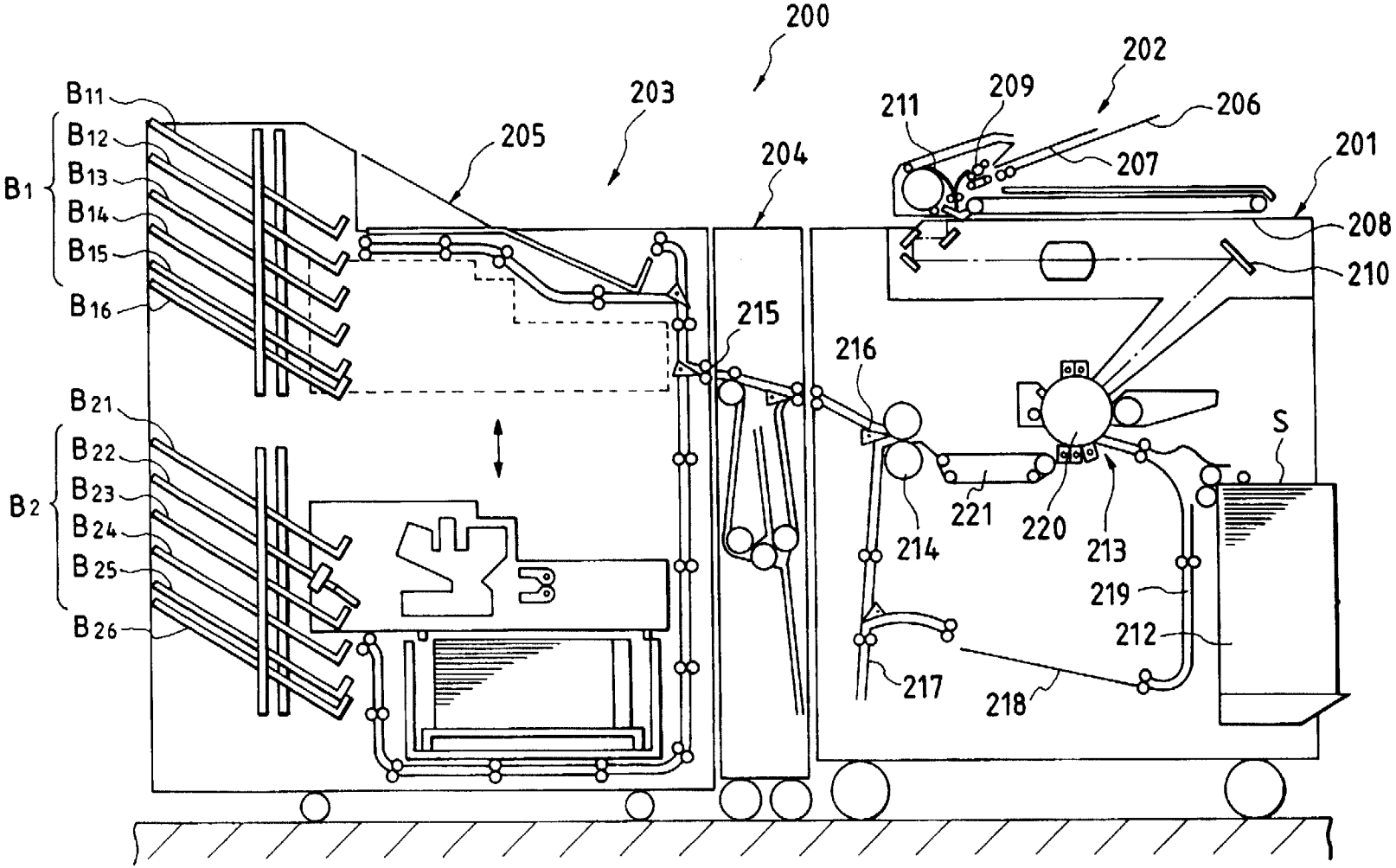
FIG. 1 is a longitudinal cross-sectional view showing the constitution of an electrophotographic copying machine in one embodiment of an image forming apparatus of the present invention.
Figure 2:
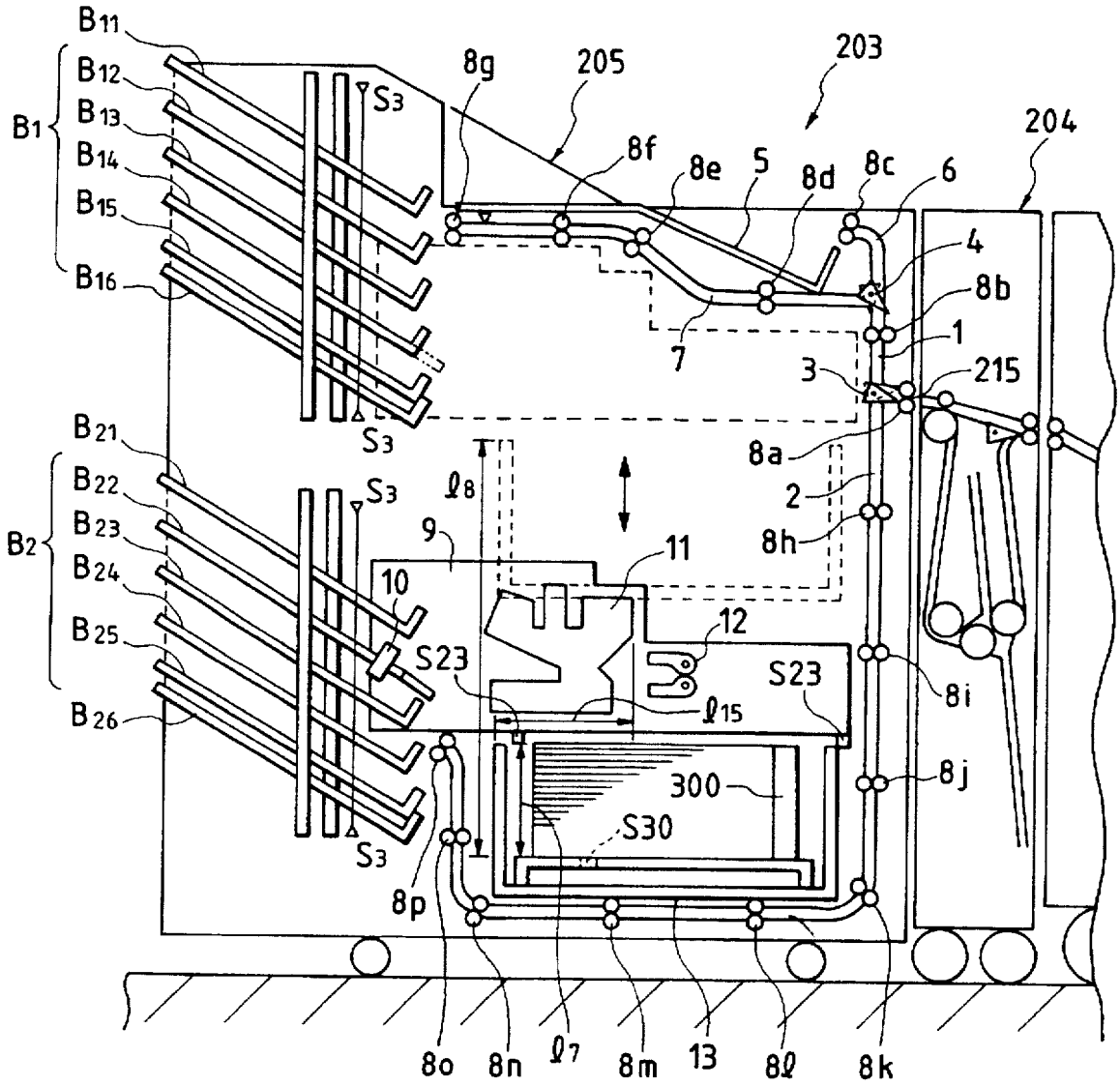
FIG. 2 is a longitudinal cross-sectional view showing the constitution of a staple/stack device of FIG. 1 in detail.

FIG. 1 is a longitudinal cross-sectional view showing the constitution of an electrophotographic copying machine in one embodiment of an image forming apparatus of the present invention, and FIG. 2 is a longitudinal cross-sectional view showing in detail the constitution of a staple/stack device of FIG. 1.

The electrophotographic copying machine 200 comprises a copying machine main unit 201, an automatic original feeder 202 disposed on the upper portion of the copying machine main unit 201, and a sheet member post-processor 203 disposed on the exhausting side of sheet member S in the copying machine main unit 201, as shown in FIG. 1.

The sheet member post-processor 203 has a folder 204, and a staple/stack device 205.

Original sheets 207 laid on an original tray 206 of the automatic original feeder 202 are separated one by one from the bottom, and fed via a path 209 onto a platen glass 208 of the copying machine main unit 201. An image of an original 207 fed onto the platen glass 208 is read by an optical system 210 within the copying machine main unit 201, and after the completion of the reading, the original 207 is exhausted from the platen glass 208 via a path 211 onto the uppermost face of the original tray 206.

The image of the original 207 read by the optical system 210 is formed as an electrostatic latent image on a photosensitive drum 220 of an image forming section 213. In the image forming section 213, the electrostatic latent image formed on the photosensitive drum 220 is visualized as a visible image for transfer onto the sheet member S fed from a deck 212.

The sheet member S onto which the visible image is transferred is transported via a transport passage 221 to a fixing portion 214 where the visible image is fixed on the sheet member S.

The sheet member S exhausted from the fixing portion 214 is sent out into either of a reversal path 217 for reversing the image formation face of sheet member S (face change in the both-side copy mode) by changing a deflector 216 and a path for leading to the folder 204.

The sheet member S sent out into the reversal path 217, after its image formation face is changed, is fed onto an intermediate tray 218, and once loaded thereon. The sheet member S on the intermediate tray 218 is fed via a resupply path 219 to the image formation section 213 again, where an image is formed on the changed face of the sheet member S.

On the contrary, the sheet member S sent out into the path for leading to the folder 204 normally passes through the folder 204 without being processed, and is transported into a sheet transport inlet port 215 for the staple/stack device 205.

Note that an image forming process on the copying machine main unit 201 is well known, and will not be explained in more detail herein. Also, the folder 204 is identical to those as disclosed in Japanese Patent Laid-Open Application No. 60-232372, and Japanese Patent Laid-Open Application No. 62-59002, and will not be explained herein.

The staple/stack device 205 has bin modules B1, B2 divided into upper and lower two portions, for receiving the sheet member transported into the sheet transport inlet port 215, as shown in FIGS. 1 and 2, bin modules B1, B2 being comprised of a plurality of bins B11 to B1n and B21 to B2n (n=6 in this embodiment), respectively. The bin modules B1, B2 are able to move each bin to a sheet accepting position or a sheet bundle exhausting position, independently of each other, by varying the bin interval between bins and the bin position.

At the sheet transport inlet port 215, there is a deflector 3 for selectively switching between a first transport path 1 in upper direction and a second transport path 2 in lower direction, this deflector determining the progress direction of the sheet member S entered through the sheet transport inlet port 215. The deflector 3 is driven by a solenoid (not shown).

The first transport path 1 branches into an exhaust path 6 to a non-sort tray 5 and a path 7 to a bin module B1 via a deflector 4 driven by a solenoid (not shown). If a transport passage from the first transport path 1 to the exhaust path 6 is selected by the deflectors 3, 4, the sheet member S is transported by each pair of rollers **8*a*, 8*b*, 8*c* from the sheet transport inlet port 215 via the first transport path 1 to the non-sort tray 5. If a transport passage from the first transport path 1 to the path 7 is selected, the sheet member S is transported by each pair of rollers 8*a*, 8*b*, 8*c* from the sheet transport inlet 215 via the first transport path 1** to the bin module B1.

On the contrary, the second transport path 2 forms a path from the sheet transport inlet port 215 to the bin module B2, and if the second transport path 2 is selected by the deflector 3, the sheet member S is transported by each pair of rollers **8*a*, 8*h* to 8*p*** to the bin module B2.

In a space surrounded between the path 7 to the bin module B1 and the second transport path 2 to the bin module B2, there is disposed a bundle process unit 9. The bundle process unit 9 transports a bundle in each bin in a right direction of FIGS. 1 and 2 by a first-out gripper 10, and after selectively stapling by a stapler 11, further transports the bundle in the right direction, with the leading end of the bundle gripped by a transport gripper 12. Similarly, in a space surrounded between the path 7 to the upper module B1 and the path to the lower module B2, a stack unit 13 waits under the bundle process unit 9 to store the bundle transported by the transport gripper 12.

Also, the right end portion of the stapler 11 and the left end portion of the stack unit 13 substantially overlap in the left and right directions, as shown in FIG. 2, an overlapping area in the left and right directions being indicated by a width 115.

The bundle process unit 9 and the stack unit 13 are moved to a position as indicated by the broken line in FIGS. 1 and 2 to take out a sheet bundle from each bin B11 to B16, if a predefined number of sheet bundles are loaded on each bin B1l to B16 of the bin module B1.

After the end of taking out the sheet bundle from each bin B11 to B16, or after the end of transportation of the sheet member to each bin B21 to B26 of the bin module B2, the bundle process unit 9 and the stack unit 13 take out a sheet bundle from the bin module B2 at a position as indicated by the solid line in FIGS. 1 and 2.

The operation of taking out the sheet bundle is continuously repeated until the stack unit 13 is filled, whereby the copy operation can be continued until the stack unit 13 is filled. the stack height of the stack unit 13 is determined by the height from a stack tray loading plane as hereinafter described to the upper end of a stacker reference wall, the maximum stack height of the stack unit 13 being set to 17 in FIG. 2.

Each bin module B1, B2 is provided with a through sensor S3 for sensing the presence or absence of sheet member S on respective bins, as shown in FIG. 2, a detection signal of each through sensor S3 being used to determine the timing of switching between the bin modules B1, B2, as hereinafter described, or the copying operation start timing of the next job.

The detailed constitution of each unit will be described below.

Figure 3:
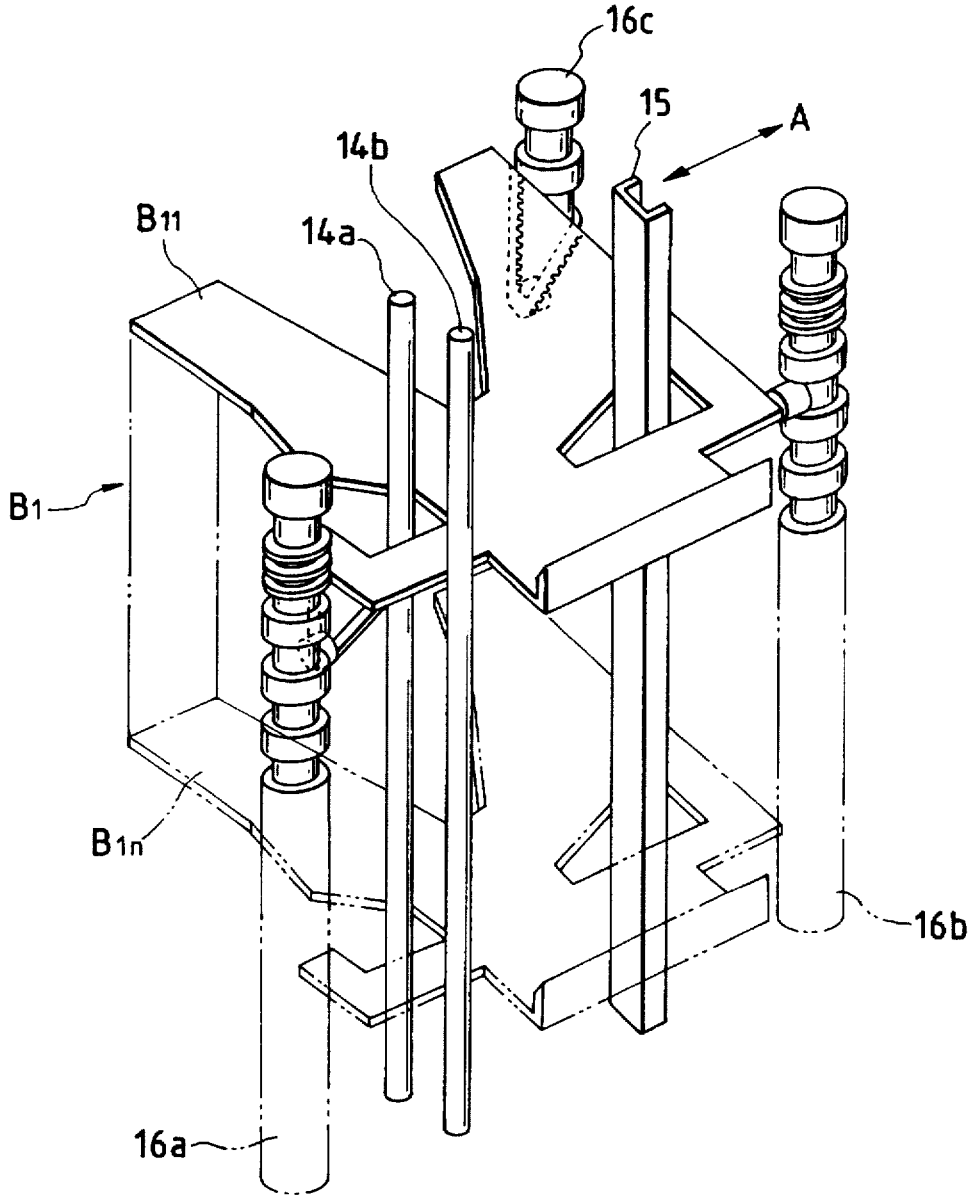
FIG. 3 is a perspective view showing a bin module provided on the staple/stack device of FIG. 1.
Figure 4:
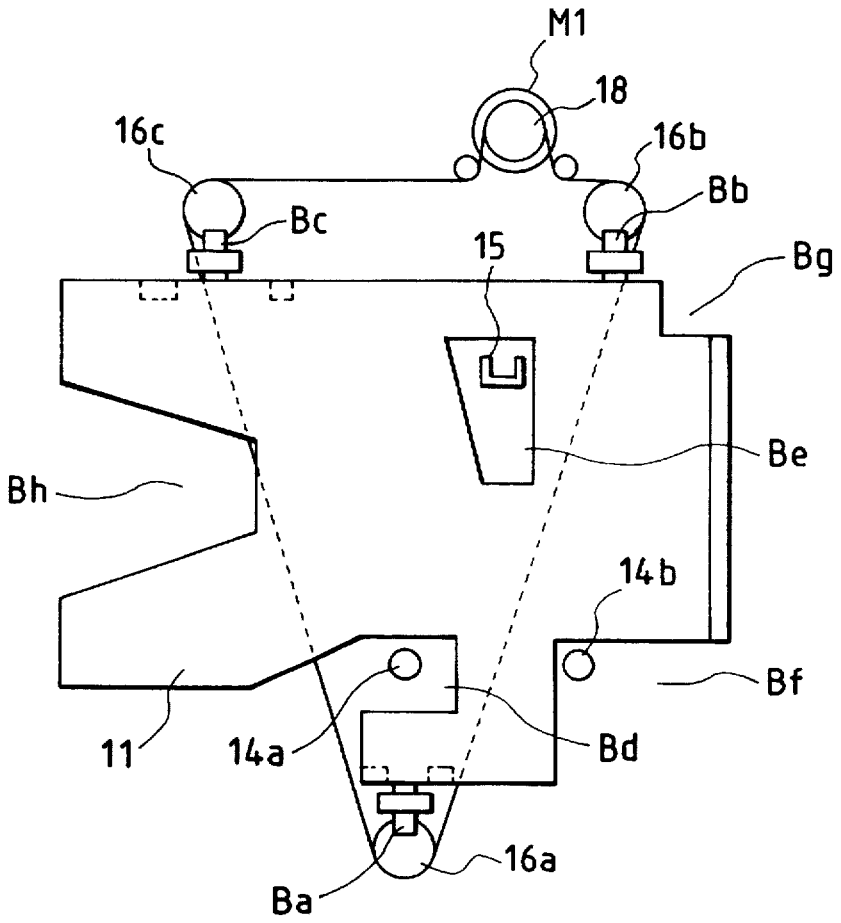
FIG. 4 is an upper view showing the bin module provided on the staple/stack device of FIG. 1.
Figure 5:
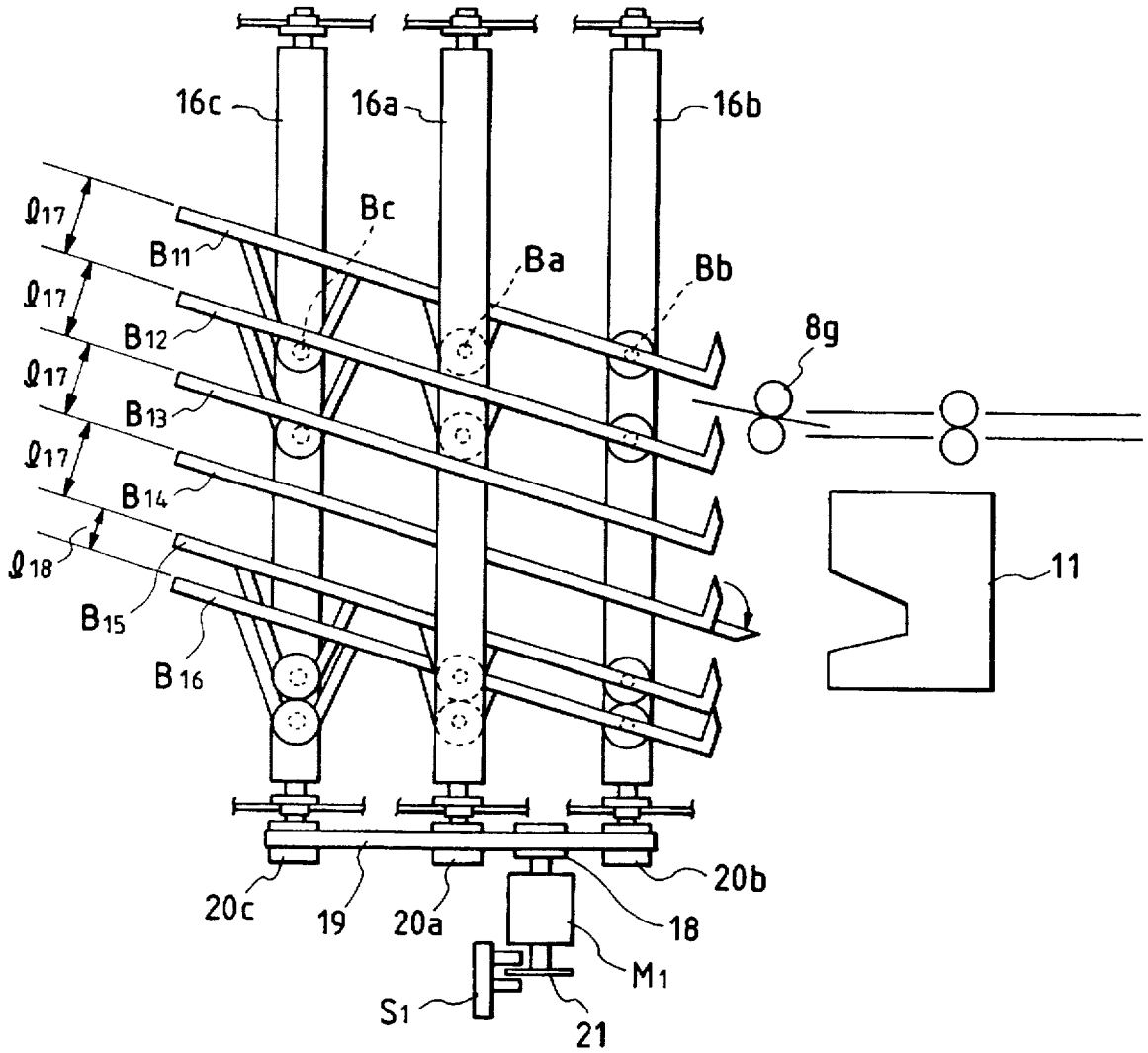
FIG. 5 is a front view showing the bin module provided on the staple/stack device of FIG. 1.

First, the bin modules B1, B2 will be described below with reference to FIGS. 3 and 4. FIG. 3 is a perspective view showing a bin module provided in the staple/stack device of FIG. 1. FIG. 4 is an upper view showing the bin module provided in the staple/stack device of FIG. 1, and FIG. 5 is a front view showing the bin module provided in the staple/stack device of FIG. 1. Note that since the bin modules B1 and B2 are of the same constitution, the bin module B1 is only described and the explanation for the bin module B2 is omitted.

The bin module B1 is comprised of a plurality of bins B11 to B1n, two reference poles 14*a*, 14*b*, an aligning wall 15, three lead cams 16*a* to 16*c* for elevating or lowering each bin, and a driver for driving these parts, as shown in FIG. 3.

The reference poles 14*a*, 14*b* are parts for determining the reference line in post-processing, e.g., stapling, the sheet members S exhausted onto each bin, and are normally set at the positions slightly escaped from the end portion of the sheets when exhausted.

The aligning wall 15 aligns the sheet members S by abutting the end portion of sheet members S against the reference poles 14*a*, 14*b*, in the manner of shifting the sheet members S widthwise in a direction perpendicular to the sheet transport direction (a direction indicated by the arrow A of FIG. 3), for every predetermined number of sheet members S exhausted onto each bin B11 to B1n.

The lead cams 16*a*, 16*b* are disposed on the rear side of the bin, and a lead cam 16*c* is disposed on the fore side of the bin, as shown in FIGS. 3 and 4.

On the outer circumference of each lead cam 16*a*, 16*b*, 16*c* is formed a spiral cam portion. The cam portion of each lead cam 16*a*, 16*b*, 16*c* is engaged by a bin roll Ba, Bb, Bc provided to project into each bin, lead cams 16*a*, 16*b*, 16*c* elevating or lowering each bin by a predetermined amount of pitch for every rotation in synchronism.

Note that each bin B11 to B1n is formed with a notch Bd corresponding to a reference pole 14*a* and a hole Be corresponding to the aligning wall 15, as shown in FIG. 4, as well as a gripper notch Bf, a bin stand drive mechanism notch Bg and a notch necessary for the operation, as will be described later.

Bins B11 to B1n are arranged, parallel to one another, and at a predetermined angle to a horizontal direction, as shown in FIG. 5. The interval between each bin B11 to B1n in upper and lower direction can be varied depending on the situation such as accepting or exhausting the sheet bundle. For example, when B14 is in a bundle transport position, the bin interval between each bin B11 to B15 is set to 117, and the interval between B15 and B16 is set to 118.

On the contrary, bin rolls Ba, Bb, Bc are constructed to be all at the same height in a state where bins B11 to B1n are inclined. That is, the position of a bin roll Bb on the bin rear side is near the reference plane of bin, while the position of a bin roll Ba on the bin fore side and the position of a bin roll Bc in the middle of bin are below the reference plane of bin, each bin roll Ba, Bc and a corresponding bin being secured together by a securing arm of V-character shape.

As will be clear from FIGS. 1 and 2, since the sheet accepting position and the bundle transport position in the upper and lower bin modules B1, B2 are in opposite relation between the bin module B1 and the bin module B2, the bundle process unit 9 and the stack unit 13 can be commonly used in taking out the sheet from the upper and lower bin modules B1, B2.

The bin shift driving will be described below with reference to FIGS. 4 and 5.

The bin shift driving is performed by a bin shift motor M1, as shown in FIGS. 4 and 5. A drive force of the bin shift motor M1 is transmitted in synchronism via a motor pulley 18, a belt 19, and lead cam pulleys 20*a* to 20*c* to lead cams 16*a* to 16*c*. Each lead cam 16*a* to 16*c* is rotated in a forward or backward direction in accordance with the positive or negative rotation of the bin shift motor M1, and by this rotations, each bin B11 to B1n is elevated or lowered.

The bin shift motor M1 has two output shafts, one output shaft having a pulley 18 attached and the other output shaft having an encoder 21 attached. The number of rotations of the encoder 21, i.e., the number of rotations of the bin shift motor M1 is detected by the sensor S1.

Each bin module B1, B2 is provided with a bin home position sensor (not shown), which senses that each top bin B11, B21 is located one bin below the sheet accepting position.

The switch timing of each bin module B1, B2 occurs based on a detection signal of a through sensor S3 (as shown in FIG. 2).

The constitution of a drive mechanism for the aligning wall 15 for aligning the sheet members S on the bin will be described below.

The aligning wall 15 is driven by an aligning wall drive motor (not shown) consisting of a stepping motor. A driving force of the aligning wall drive motor is transmitted via a transmission including a gear and a timing belt to the aligning wall 15, whereby the positional control of the aligning wall 15 can be effected by supplying a proper number of pulses to the aligning wall drive motor. Note that the more position of the aligning wall 15 is detected by a sensor (not shown).

Figure 6:
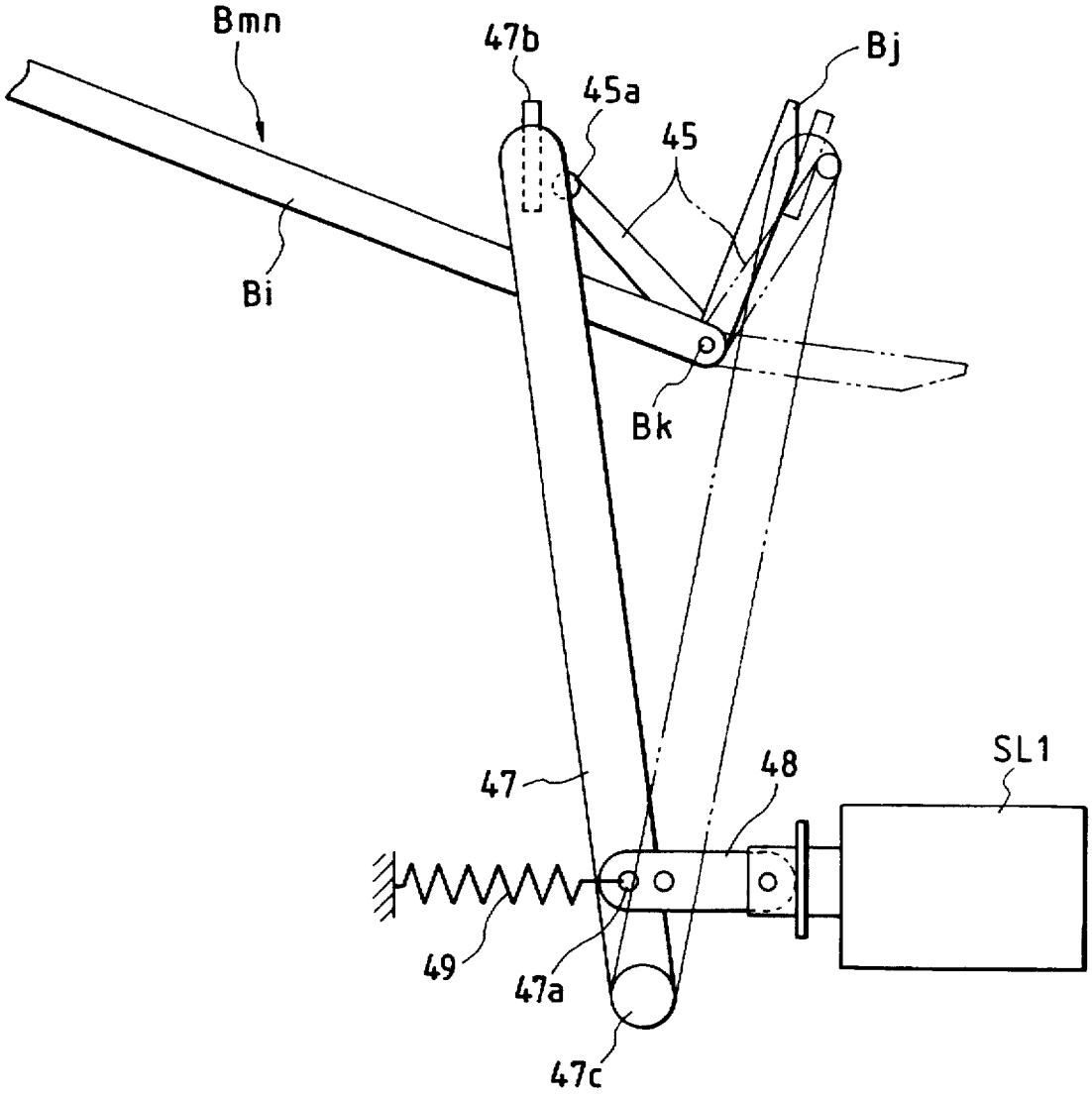
FIG. 6 is a side view showing the constitution of a bin stand portion provided on the staple/stack device of FIG. 1.

Referring now to FIG. 6, the constitution of a drive mechanism for the bin stand portion for forming the reference plane for alignment with the conveying direction of sheet members S on the bin will be described below. FIG. 6 is a side view showing the constitution of the bin stand portion provided on the staple/stack device of FIG. 1.

Each bin Bmn (m=1,2, n=1,6) is comprised of a sheet loading portion Bi and an aligning portion Bj (also referred to as bin stand portion), as shown in FIG. 6, the aligning portion Bj being provided around a support axis Bk rotatably fitted into a hole provided in the sheet loading portion Bi. This aligning portion Bj is rotated over a certain angle around the support axis Bk between a stand position substantially at right angles to a loading plane of the sheet loading portion B1 and a position substantially parallel to the loading plane of the sheet loading portion B1 its rotational angle being approximately equal to 90°. If the aligning portion Bj is in the standing position at right angles to the loading plane of the sheet loading portion Bi, an aligning plane for aligning the sheet bundle loaded on a bin Bmn by the aligning portion Bj is formed. On the contrary, when the aligning portion Bj is moved to a position substantially parallel to the loading plane of the sheet loading portion Bj, a transport inlet port for carrying the sheet bundle loaded on the bin Bmn into the bundle process unit 9 is formed. This driving of the aligning portion Bj is referred to as bin stand driving.

The aligning portion Bj is provided with a drive arm 45 for extending over the bin sheet member loading plane, at the top end of the driving arm 45 being provided a pin 45*a*.

The aligning portion Bj is driven by a solenoid SL1. The solenoid SL1 is borne on a base board (not shown). An output shaft of the solenoid SL1 is connected via an arm 48 to a pin 47*a* of a link 47. The link 47 is attached, at one end, rotatably over a certain angle around a support shaft 47*c* secured to the base board, and at the other end provided with a pin abutment member 47*b*.

One end of a spring member 49 is attached to the pin 47*a* of the link 47, with the other end being attached to the base board.

The link 47 is rotated angularly in accordance with the operation of the solenoid SL1. When the solenoid SL1 is in off operation, that is, in a normal state, the link 47 is moved to a position of the solid line as shown in FIG. 6 by a spring force of the spring member 49. That is, the aligning portion Bj is moved to the standing position at right angles to the loading plane of the sheet loading portion B1 thereby forming an aligning face for aligning the sheet bundle loaded on the bin Bmn. At this position, since the bin abutment member 47*b* of the link 47 and the pin 45*a* are separated apart from each other, the bin Bmn can be elevated or lowered, without interference between the pin abutment member 47*b* of the link 47 and the pin 45*a*, in the normal state.

When the sheet bundle onto the bin Bmn is transported to the bundle transport unit 9, the solenoid SL1 is turned on, after the bin Bmn has been shifted to a predetermined position. Upon turning on the solenoid SL1, the link 47 is rotated, so that the pin abutment member 47*b* abuts against the pin 45*a*. The aligning portion Bj is moved to a position of the two-dot chain line as shown in FIG. 6, thereby forming a transport inlet port for transporting the sheet bundle loaded on the bin Bmn into the staple/stack device 205.

Figure 7:
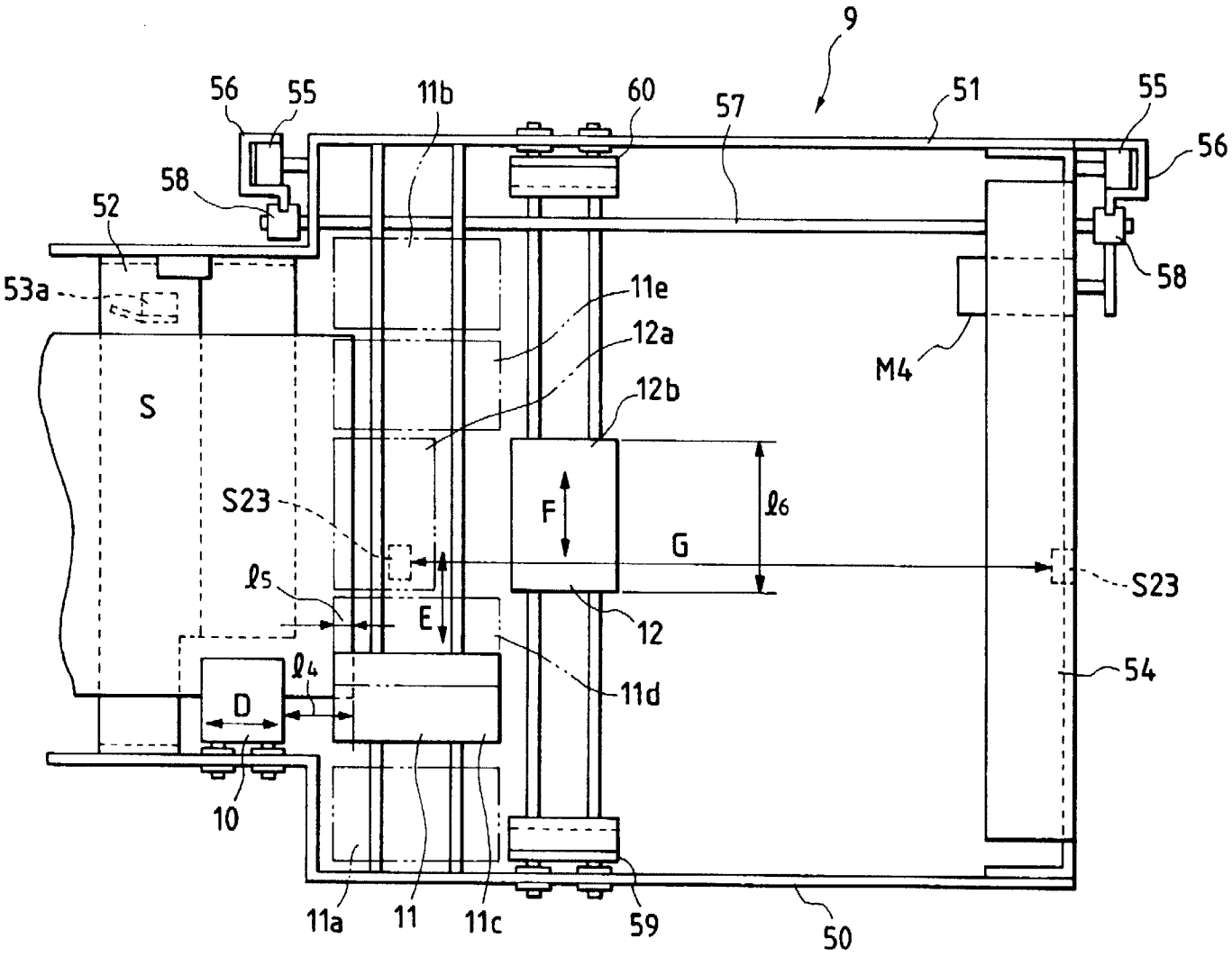
FIG. 7 is an upper view showing a bundle process unit provided on the staple/stack device of FIG. 1.
Figure 8:
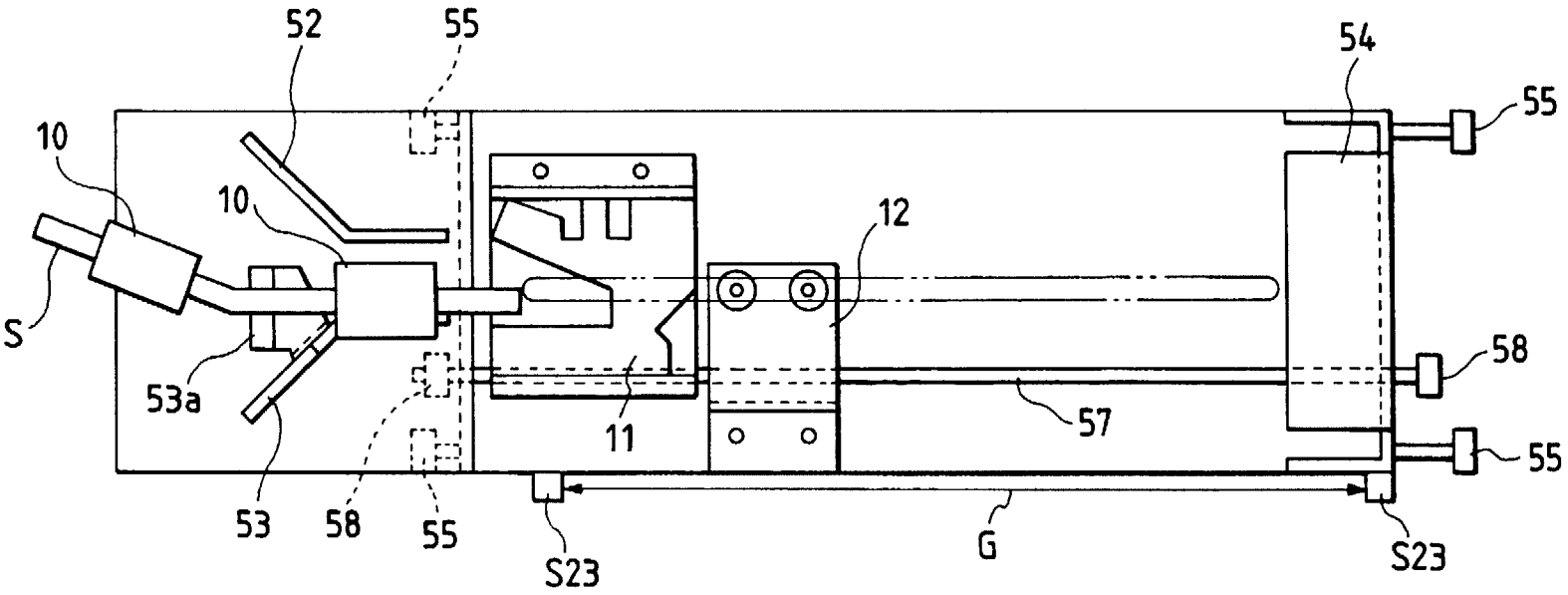
FIG. 8 is a front view of the bundle process unit of FIG. 7.

Referring now to FIGS. 7 and 8, the bundle process unit 9 will be described below. FIG. 7 is an upper view showing the bundle process unit provided on the staple/stack device of FIG. 1, and FIG. 8 is a front view of the bundle process unit of FIG. 7.

The bundle process unit 9 has a frame with guide stays 52, 53 and a right stay 54 extending between a unit front side plate 50 and a unit rear side plate 51, with a total of four lifting rolls 55 fitted, consisting of two rolls 55, left and right, on the rear side, as shown in FIGS. 7 and 8. On the rear side of a lower guide stay 53 is attached a member 53*a* for guiding the sheet bundle S in transporting the sheet bundle. Four lifting rolls 55 are guided within two rails 56 secured to the main unit, and the racks threaded along with rails 56 are mated with pinion gears 58 provided at both ends of a shaft 57 extending through the frame transversely, so that when a drive force from an lifting motor M4 is transmitted to the pinion gears 58, the whole frame is lifted vertically.

The frame of the bundle process unit 9 is provided with a pair of sensors S23 for detecting the uppermost face of sheet bundle stacked on a stack tray 116 as hereinafter described, as shown in FIG. 2, FIG. 7 and FIG. 8. The sensors 23 cooperate with each other to form a detected light path extending in a direction as indicated by the arrow G of FIG. 7.

Within the frame of the bundle process unit 9, there are disposed three moving bodies including a first-out gripper 10, a stapler 11, and a transport gripper 12. These moving bodies will be described below.

The first-out gripper 10 is movable in the directions indicated by the arrow D in FIG. 7. The first-out gripper 10 grips near the right end of the sheet bundle S on the bin which is on the fore reference side to take out the sheet bundle S in the directions of the arrow D. The distance from the right end of the first-out gripper 10 to the top end of the sheet bundle S is set to l4, which is greater than the distance l5 from the left end of the stapler 11 to the top end of the sheet bundle S.

Figure 10:
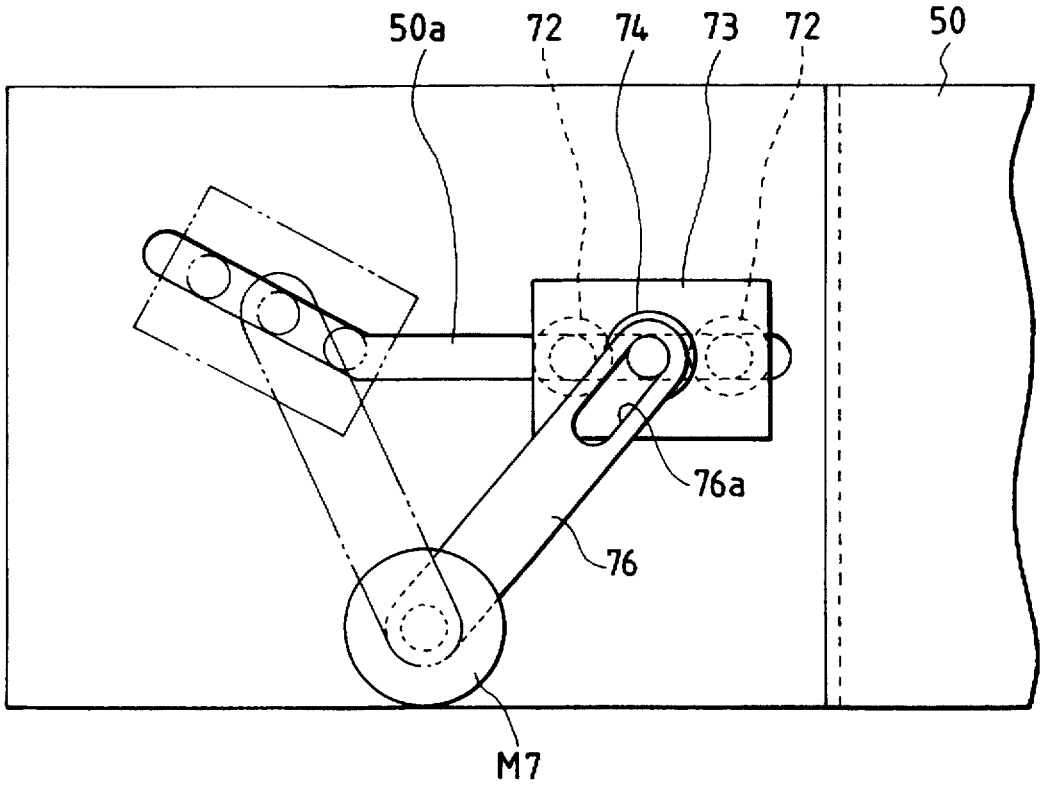
FIG. 10 is a view showing a driving mechanism for the first-out gripper in the bundle process unit of FIG. 7.

Referring now to FIG. 10, a drive mechanism of this first-out gripper 10 will be described below. FIG. 10 is a view showing the drive mechanism of the first-out gripper for the bundle process unit of FIG. 7.

On the fore side of the unit front side plate 50 is attached a first-out motor M7, with a swing arm 76 secured at the top end of the drive shaft as shown in FIG. 10. At the other end of the swing arm 76, there is formed a long hole 76*a* engaged by the leading end portion of a pin member 74 interlocked with the first-out gripper 10. The pin member 74 is formed on a connection plate 73, which is supported by a shaft of two grooved rolls 72. Each roll 72 is attached on the side face of the first-out gripper 10, a groove of each roll 72 being mated with a long hole 50*a* of the unit front side plate 50.

If the first-out motor M7 is driven, the swing arm 76 is reciprocated between a position of the solid line and a position of the two-dot chain line in FIG. 7. Thereby, the first-out gripper 10 grips the sheet bundle at an inclined position along the long hole 50*a* of the unit front side plate 50 to transport the sheet bundle to a horizontal position for releasing the sheet bundle therein, and is returned to the inclined position again.

The stapler 11 is movable in the directions of the arrow E in FIG. 7, wherein its movable position is set to any of an escape position (a position 11*a* as shown in FIG. 7) on the fore side not overlapping the sheet width, an escape position on rear side (a position 11*b* of FIG. 7), and any positions at the top end portion of the sheet bundle (e.g., positions 11*c*, 11*d*, 11*e* of FIG. 7).

Figure 13:
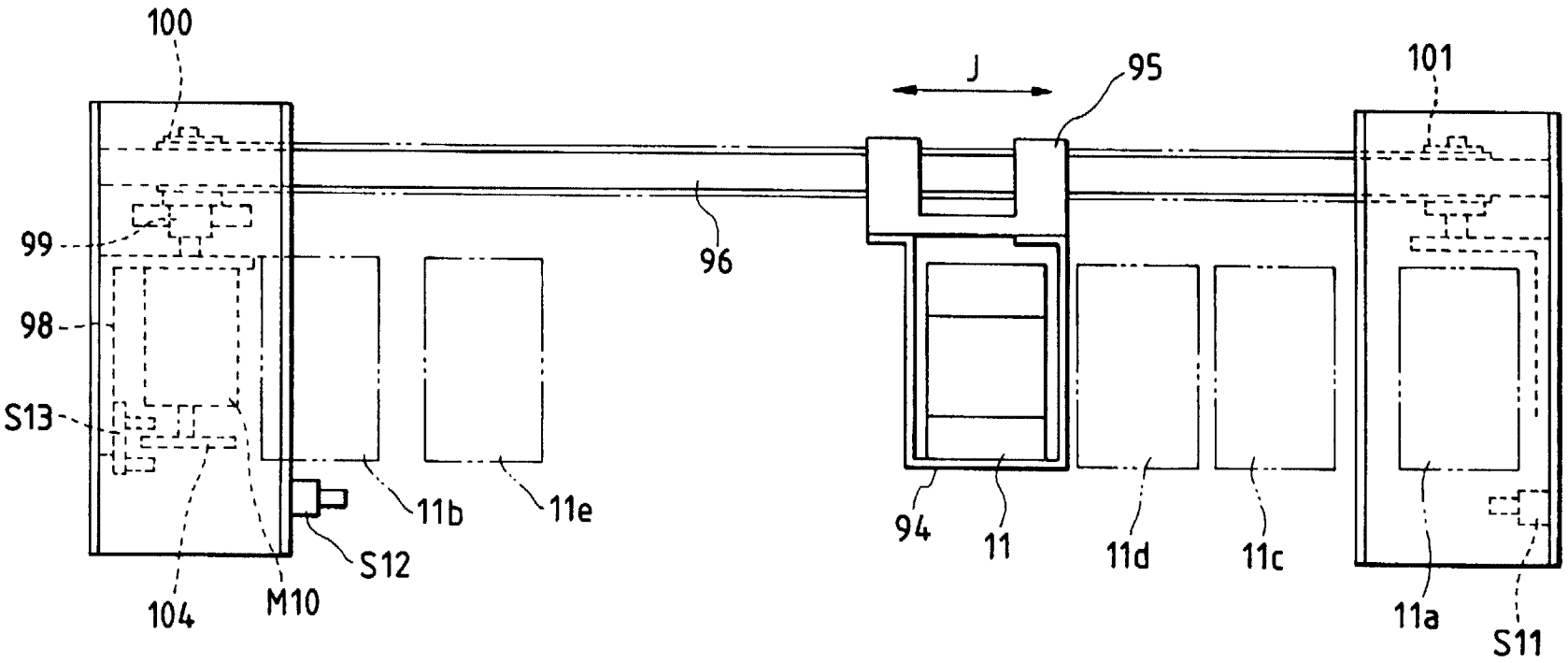
FIG. 13 is a left-side view showing a driving mechanism for a stapler in the bundle process unit of FIG. 7.
Figure 14:
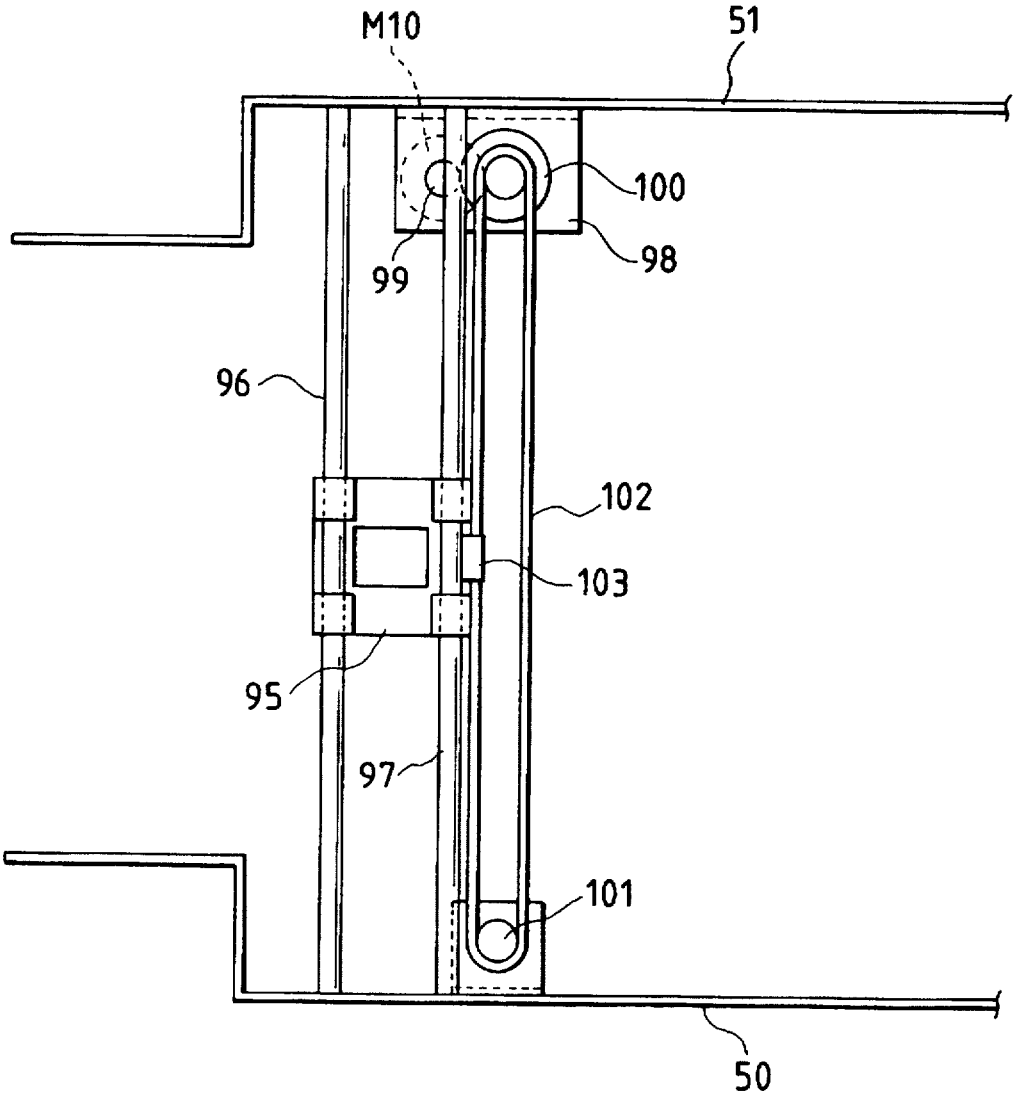
FIG. 14 is a right-side view showing the driving mechanism for the stapler in the bundle process unit of FIG. 7.

Referring to FIGS. 13 and 14, the driving of this stapler 11 will be described below. FIG. 13 is a left view showing a drive mechanism of the stapler in the bundle process unit of FIG. 7, and FIG. 14 is an upper view showing the drive mechanism of the stapler in the bundle process unit of FIG. 7.

The stapler 11 is fixed to the base board 94, as shown in FIG. 13. A slider 95 attached to the upper portion of the base board 94 has two shafts 96, 97 for suspending and supporting the stapler 11 extending therethrough, both ends of each shaft 96, 97 being borne by the unit front and back side plates 50, 51, respectively, as shown in FIGS. 13 and 14. The slider 95 is secured to a belt 102 with a regulating member 103, the belt 102 being looped around a drive pulley 100 and a driven pulley 101, to which a drive force from the stapler forward the backward motor M10 fixed to a base 98 is transmitted via a gear 99.

Hence, the slider 95, i.e., the stapler 11 can be moved between the escape position 11*a* on the fore side and the escape position 11*b* on the rear side in the directions of the arrow J of FIG. 13 by the stapler forward the backward motor M10, its stop position being settable to any position between the escape position 11*a* on the fore side and the escape position 11*b* on the rear side. The position setting can be made based on a detection signal from a fore-hand position sensor S11 or a rear-hand position sensor S12 and a detection signal from a sensor S13 for reading the output of an encoder 104 for the stapler forward and backward motor M10.

The transport gripper 12 is movable in the directions as indicated by the arrow F, and as a whole, together with the front and back side plates 59, 60, movable in the direction as indicated by the arrow G, as shown in FIG. 7. The transport gripper 12 grips an almost central portion of the sheet width by moving in the directions as indicated by the arrow F in accordance with the size of sheet bundle, and transports the sheet bundle to the stack unit 13 by moving in the direction as indicated by the arrow G to completely draw out the sheet bundle from the bin. The movement in the directions as indicated by the arrow F is made corresponding to the sheet size as above described, and for the purpose of classification on the stack unit 13. That is, when transporting the sheet bundle to the stack unit 13, the amount of transport in the direction as indicated by the arrow G depends on the size of sheet bundle, but the sheet bundles of the same size or the sheet bundles between different jobs can be classified by changing the amount of transport in the directions of the arrow F.

Note that the depth size l6 of the transport gripper 12 is set such that the transport gripper 12 is able to grip the top end of sheet bundle at a position where the stapler 11 operates on the sheet bundle S.

Figure 11:
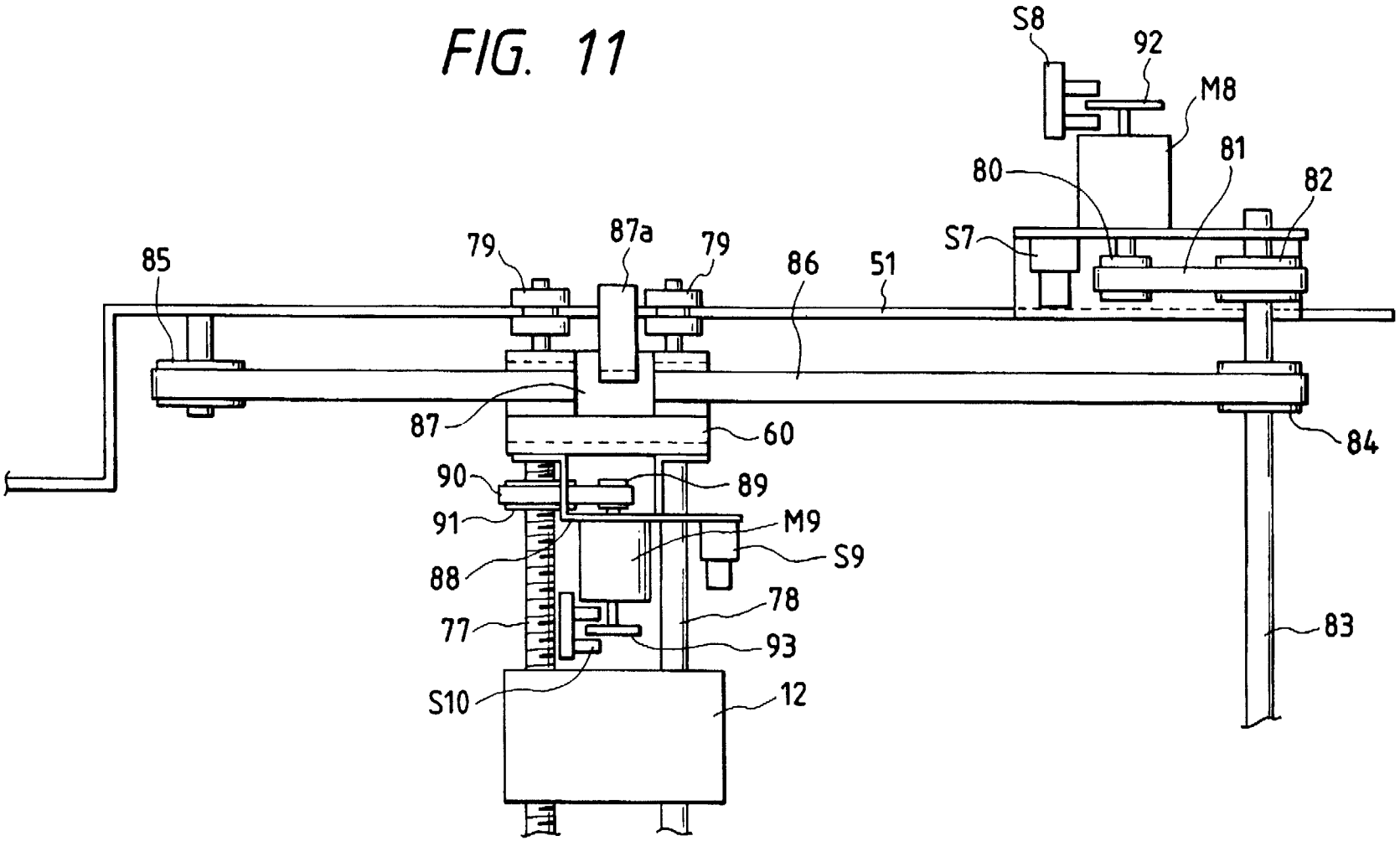
FIG. 11 is an upper view showing a driving mechanism for the transport gripper in the bundle process unit of FIG. 7.
Figure 12:
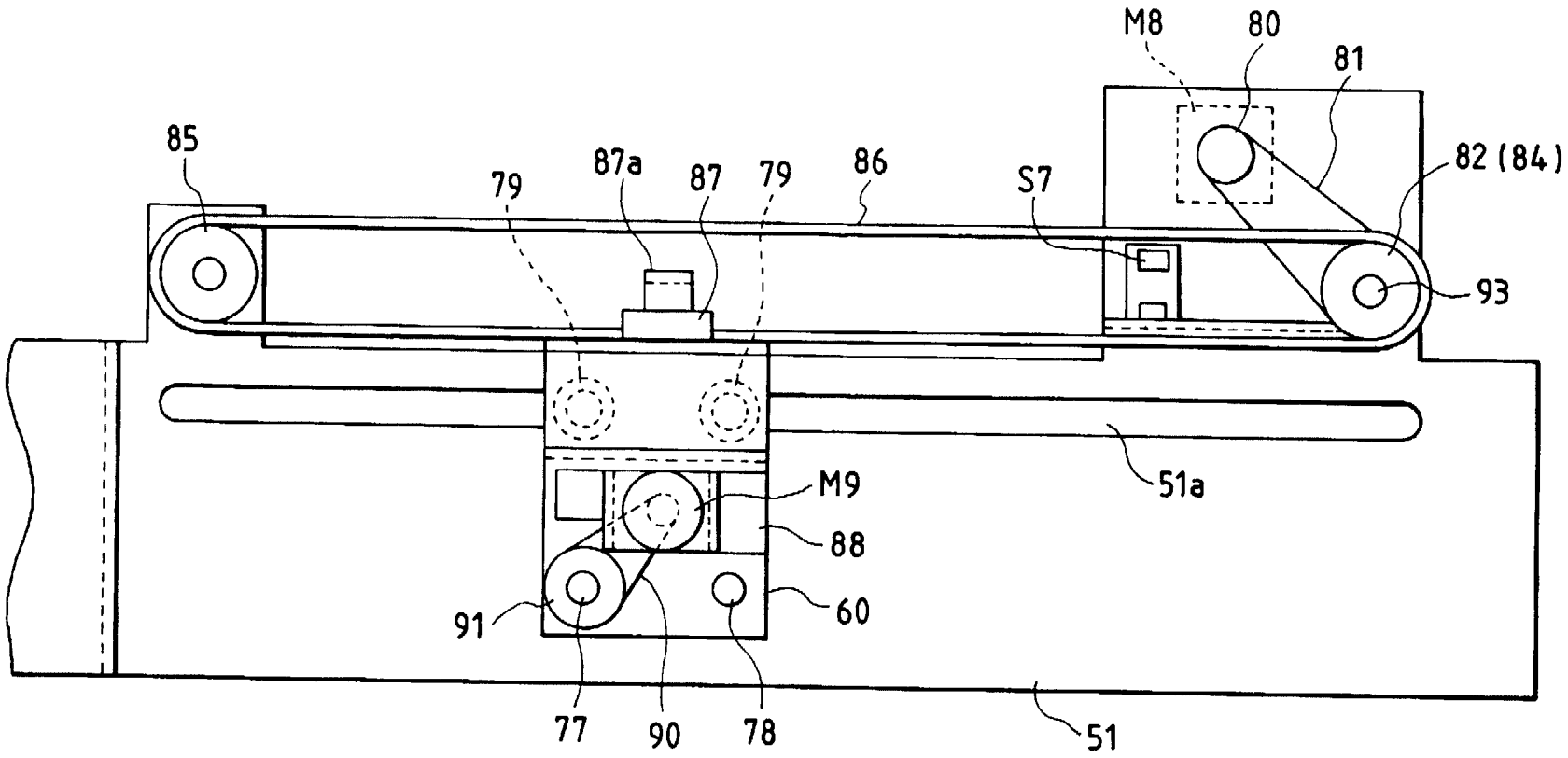
FIG. 12 is a front cross-sectional view showing the driving mechanism for the transport gripper in the bundle process unit of FIG. 7.

Referring now to FIGS. 11 and 12, a drive mechanism of the transport gripper 12 will be described below. FIG. 11 is an upper view showing the drive mechanism of the transport gripper in the bundle process unit of FIG. 7, and FIG. 12 is a front cross-sectional view showing the drive mechanism of the transport gripper in the bundle process unit of FIG. 7.

The transport gripper 12 is supported by two shafts 77, 78, one shaft 77 being comprised of a ball screw, and the other shaft being comprised of a normal shaft, as shown in FIGS. 11 and 12. The both ends of the shaft 77 are rotatably borne by the front and back side plates (a front side plate omitted, a back side plate 60), and both ends of the shaft 78 are fixed. The front and back side plates are respectively provided with two rolls 79, each roll 79 being movably fitted into a long hole 51*a* provided on the unit side plate 51.

First, the driving of the transport gripper 12 in the direction of transporting the sheet bundle or in the longitudinal direction of the unit side plate 51 will be described below.

For the driving of the transport gripper 12 in the direction of transporting the sheet bundle, a transport gripper left and right moving motor M8 attached to the unit side plate 51 is used. A driving force of the transport gripper left and right moving motor M8 is transmitted via a transmission mechanism comprised of a drive pulley 80, a belt 81, and a driven pulley 82 to through shaft 83. Around the through shaft 83 are the secured driven pulley 82 as well as the pulley 84, with a belt 83 being looped around the pulley 82 and an opposed pulley 85. A part of the belt 86 is secured to the back side plate 60 with a regulating member 87, wherein the belt 86 is revolved by a driving force of the transport gripper left and right moving motor M8, and each roll 79 is moved along the long hole 514 of the unit side plate 51 with the revolutions of the belt 86, that is, the back side plate 60 is moved. Hence, the transport gripper 12 can be moved in the direction of transporting the sheet bundle.

The driving of the transport gripper 12 in a direction orthogonal to the sheet bundle transport direction will be described below.

For the driving of the transport gripper 12 in the direction orthogonal to the sheet bundle transport direction, a transport gripper forward and backward moving motor M9 attached via a base 88 on the back side plate 60 is used. A driving force of the transport gripper forward and backward moving motor M9 is transmitted via a transmission mechanism comprised of a drive pulley 89, a belt 90, and a driven pulley 91 to a shaft 77. Since a portion of the transport gripper 12 engaging the shaft 77 is formed with a threaded portion mating with the shaft 77, the transport gripper is moved in an axial line direction of the shaft 77 with the revolutions of the shaft 77.

The positional control of the transport gripper 12 is made based on sensing of the home position and sensing of the rotational amount of the motor. Specifically, the movement in the sheet bundle transport direction and its stop position can be determined based on a detection signal from a home position sensor S7 by sensing a projection 87*a* of the regulating member 87 and a detection signal from a reading sensor S8 of an encoder 92 for the transport gripper left and right motor M8, while the movement in the direction orthogonal to the sheet bundle transport direction and its stop position can be determined based on a detection signal from a home position sensor S9 and a detection signal from a reading sensor S10 of an encoder 93 for the transport gripper forward and backward moving motor M9.

Figure 9:
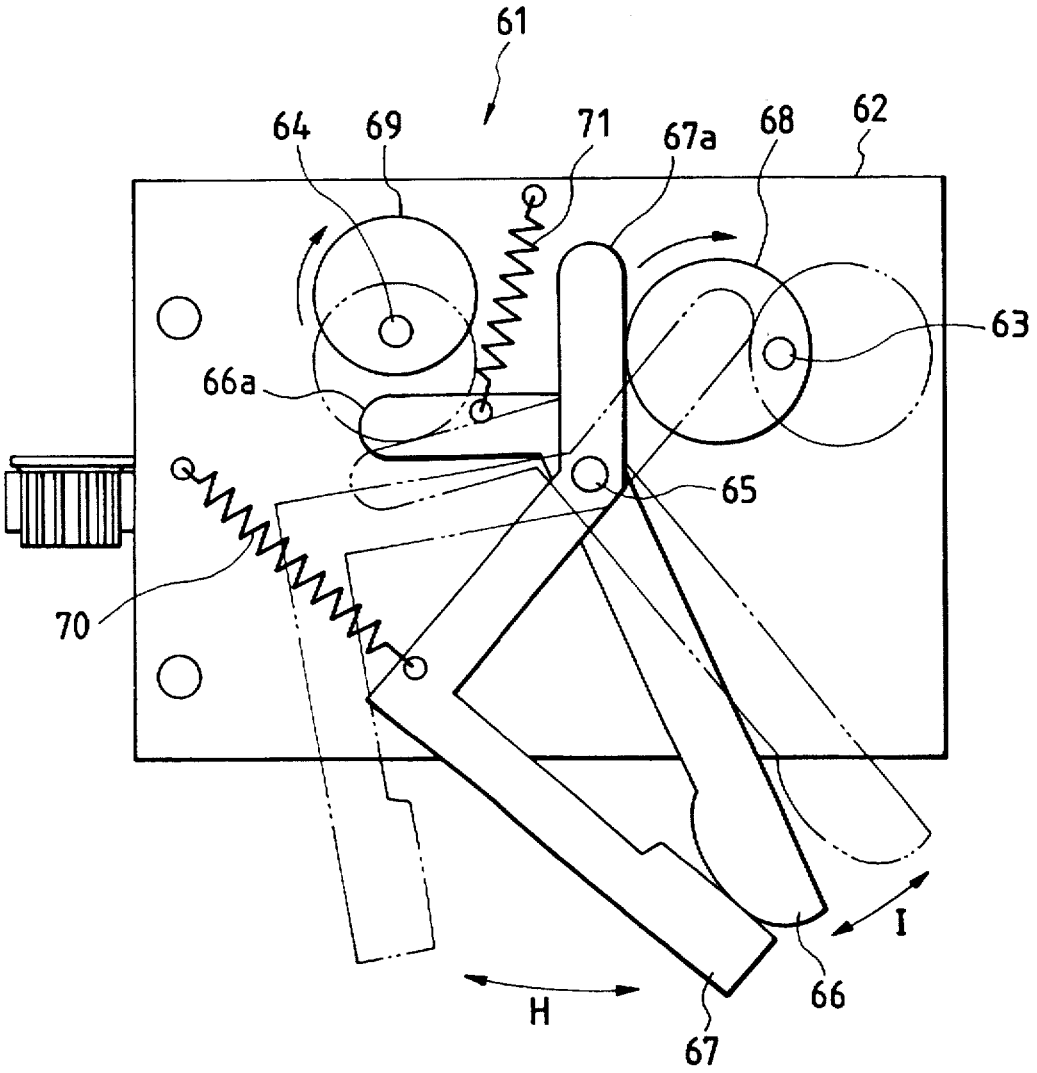
FIG. 9 is a view showing the constitution of a gripper portion for a first-out gripper 10 and a transport gripper 12 in the bundle process unit of FIG. 7.

Referring now to FIG. 9, the constitution of a gripper portion for the first-out gripper 10 and the transport gripper 12 will be described below. FIG. 9 is a view showing the constitution of the gripper portion for the first-out gripper 10 and the transport gripper 12 in the bundle process unit of FIG. 7.

The gripper portion for gripping the sheet bundle in the first-out gripper 10 and the gripper portion for gripping the sheet bundle in the transport gripper 12 have the common constitution.

The gripper portion 61 has an upper gripper 66 and a lower gripper 67 rotatably borne around a fixed shaft 65 of a side plate 62, as shown in FIG. 9. The upper gripper 66 is biased by a spring member 71 so that its end portion 66*a* may be abutted against an eccentric cam 69 rotated around a shaft 64 in a direction as indicated by the arrow in the figure. The eccentric cam 69 is secured to the shaft 64, which is rotated by a motor M5 (not shown). The upper gripper 66 is swung in the directions as indicated by the arrow I with the rotation of the eccentric cam 69.

The lower gripper 67 is biased by a spring member 70 so that its end portion 67*a* may be abutted against an eccentric cam 68 rotated around a shaft 63 in a direction as indicated by the arrow in the figure. The eccentric cam 68 is secured to the shaft 63, which is rotated by a motor M6 (not shown). The lower gripper 67 is swung in the directions as indicated by the arrow H with the rotation of the eccentric cam 68.

The opening and closing operation of the upper gripper 66 and the lower gripper 67 can be effected by repeating the swinging operation in the directions as indicated by the arrow I and the arrow H (the solid line and the broken line), respectively.

Figure 15:
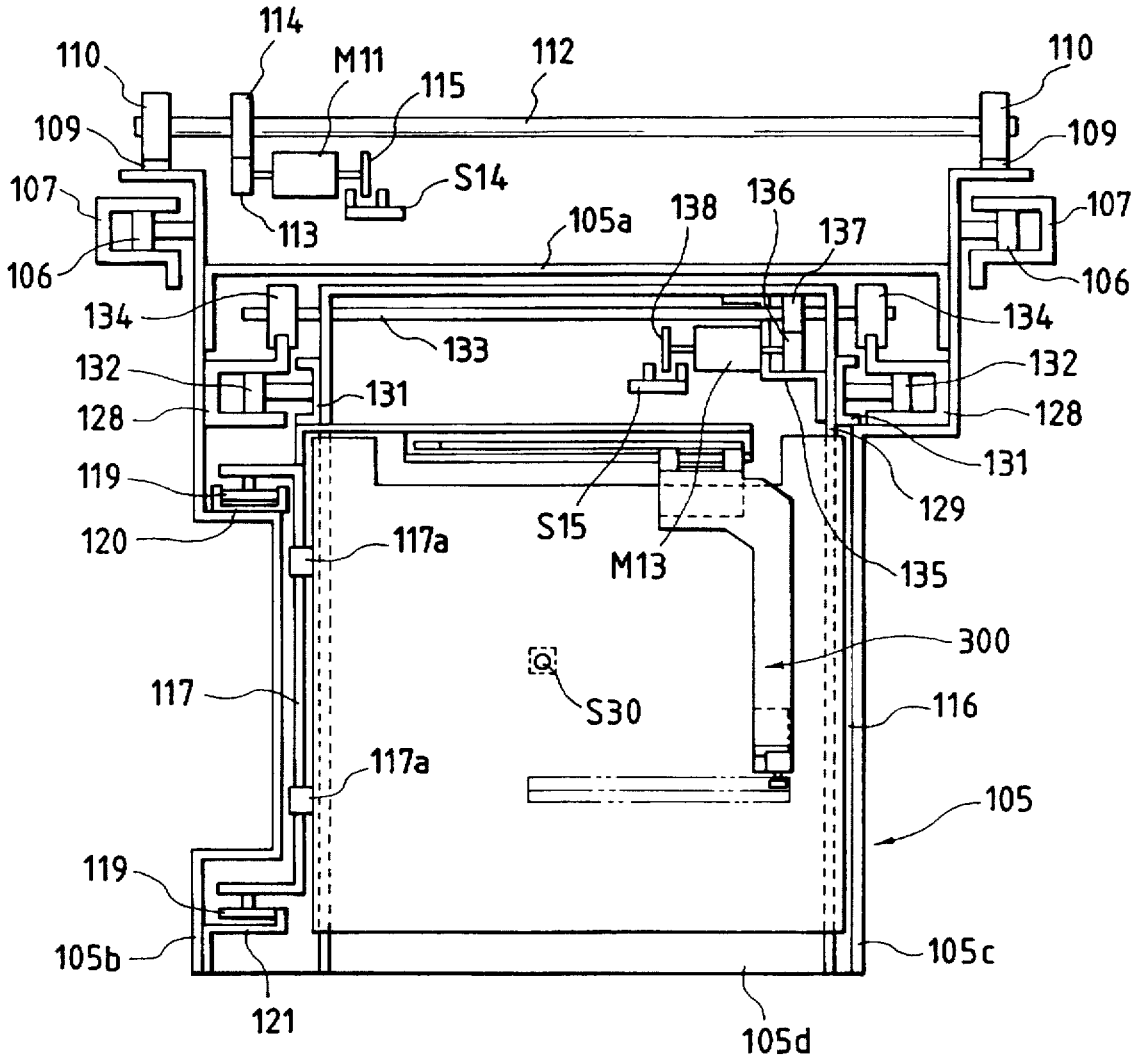
FIG. 15 is an upper view showing the constitution of a stack unit provided on the staple/stack device of the image forming apparatus of FIG. 1.
Figure 17:
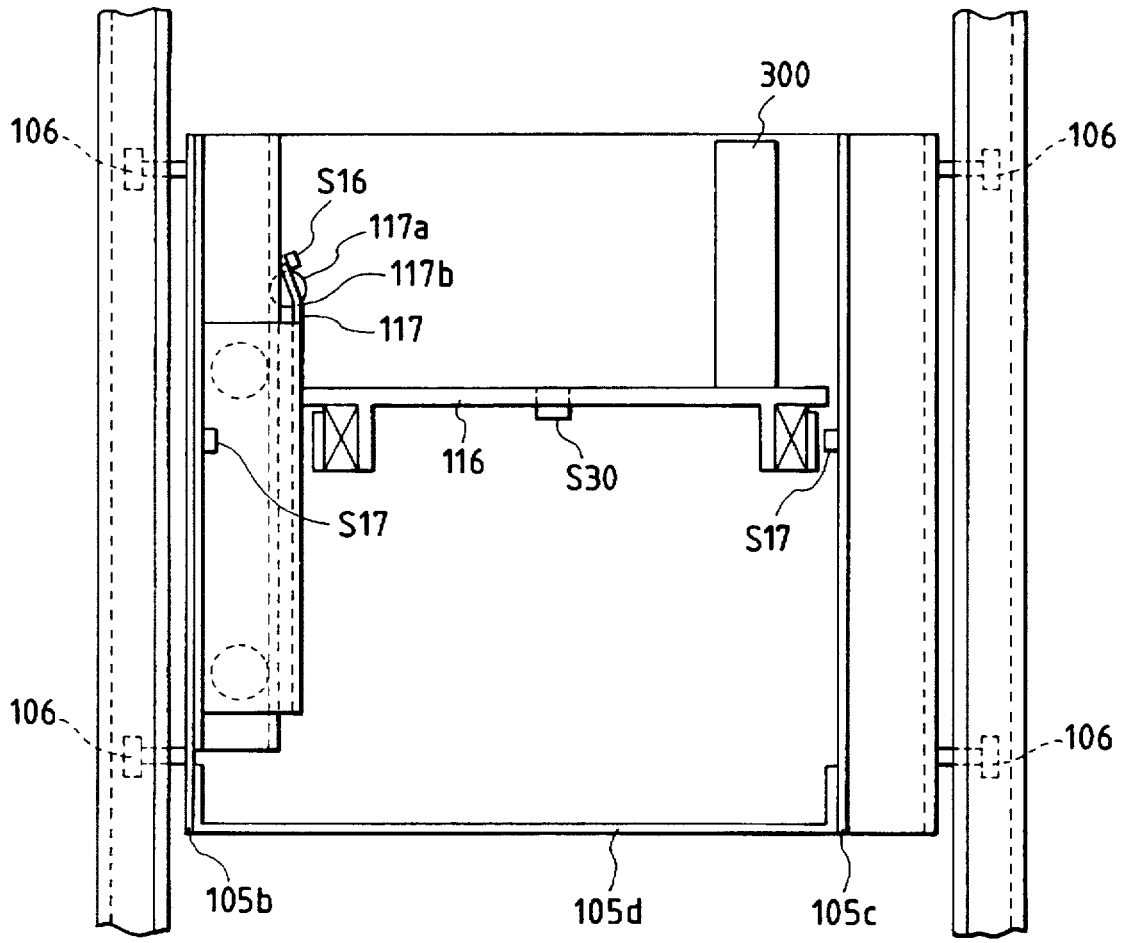
FIG. 17 is a front view showing a stack frame for the stack unit of FIG. 15.
Figure 18:
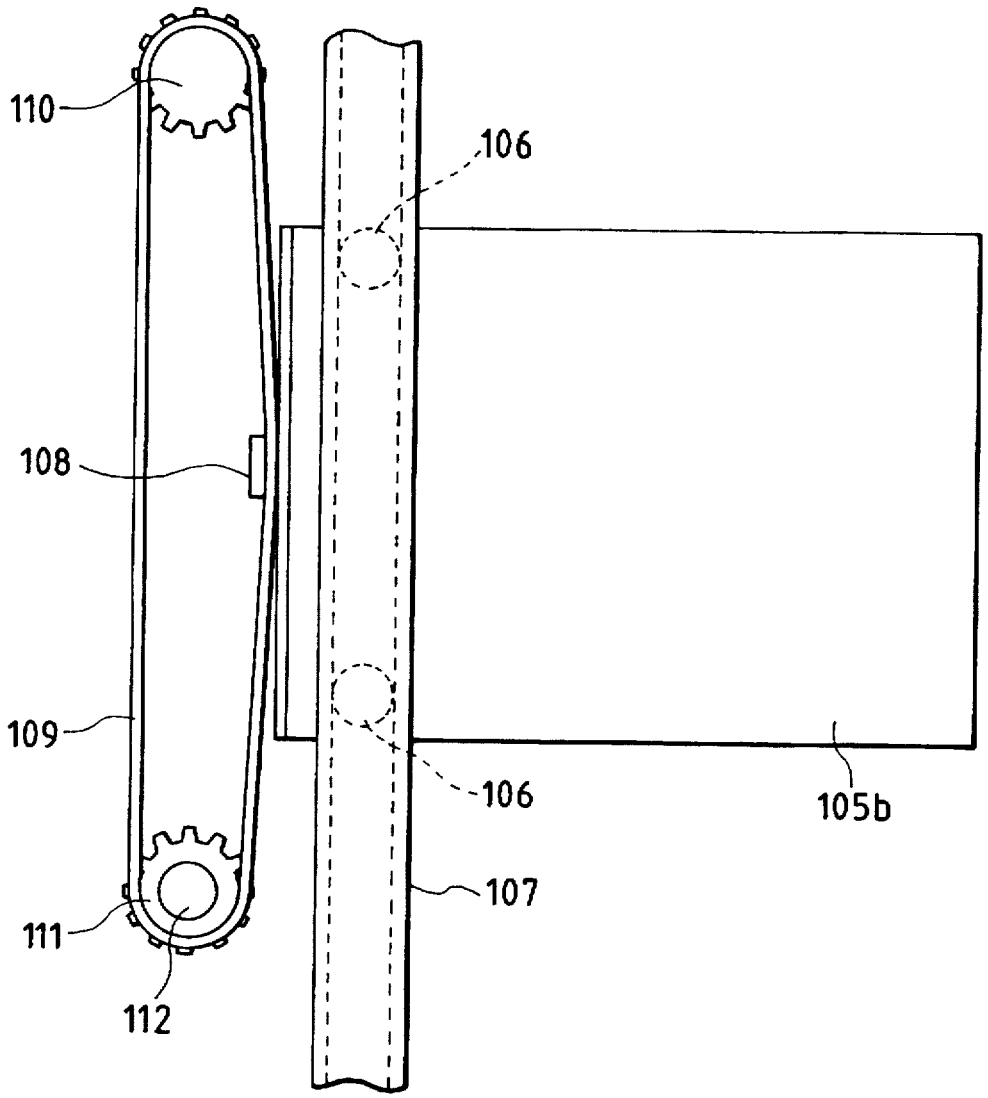
FIG. 18 is a left-side view showing the stack unit of FIG. 15.

Referring now to FIG. 15, FIG. 17 and FIG. 18, the constitution of a stack unit 13 will be described below. FIG. 15 is an upper view showing the constitution of the stack unit provided on the staple/stack device in the image forming apparatus, FIG. 17 is a front view showing a stack frame of the stack unit, and FIG. 18 is a left view showing the stack unit of FIG. 15.

A stack frame 105 which is an outer frame of the stack unit 13 is comprised of four parts including a back side plate 105*a*, a left side plate 105*b*, a right side plate 105*c*, and a bottom plate 105*d*, as shown in FIG. 15. On the rear-hand outer surfaces of the left and right side plates 105*b*, 105*c* of this outer frame, two lifting rolls 106 are provided, respectively, each lifting roll 106 being guided by a rail 107 secured to the main unit. Note that this rail 107 can be commonly made of the same material as the rail 56 of the bundle process unit 9, as shown in FIG. 7.

Each of the left and right side plates 105*b*, 105*c* has a chain 109 secured thereto with a regulating member 108, each chain 109 being looped around the upper and lower sprockets 110, 111, as shown in FIGS. 15 and 18. A lower sprocket 111 is secured to a through shaft 112, to which a drive force from a stack frame lifting motor M11 is transmitted via the gears 113, 114. The stack frame 105 is elevated or lowered with the rotations of the through shaft 112 by the drive force from the stack frame lifting motor M11.

As the stop position of the stack frame 105, a plurality of positions are normally set, including a stack tray drawing position and a position with the limited number of sheets in stack changed, as will be described later, in addition to two stop positions corresponding to two stop positions (an upper portion of the broken line and a lower portion of the solid line) of the bundle process unit 9, as shown in FIG. 2. The home position of the stack frame 105 is set at a position corresponding to the bin module B1. The positional control for this stop position is made based on a detection signal from a reading sensor S14 of an encoder 115 in the stack frame lifting motor M11, as shown in FIG. 15.

On the left side plate 105*b* of the stack frame 105 as shown in FIGS. 15 and 17, a stacker reference wall 117 which is a reference wall of sheet bundle on the stack tray 116 is liftably supported.

On an upper incline wall 117*b* of the stacker reference wall 117, a guide roll 117*a* for preventing the rear end of sheet bundle from being left behind is attached. The stacker reference wall 117 is lifted or lowered in accordance with the number of sheets stacked on the stack tray 116, while a guide roller 119 is guided by corresponding guide rails 120, 121, and for its lifting operation, a drive force from the lifting motor M12 (not shown) is used.

At an upper end of the stacker reference wall 117, a proximity prevention sensor S16 is attached, so that the distance between the stack unit 13 and its upper bundle process unit 9 can be detected, based on a detection signal from the proximity prevention sensor S16. When the stack unit 13 and the bundle process unit 9 are approached below a predetermined distance, the control for stopping respective driving in proximity direction is performed to avoid interference therebetween.

On a side face portion of the left and right side plates 105*b*, 105*c* is attached a stack height detection sensor S17, wherein the height of the stacker reference wall 117 is controlled, based on a detection signal from the stack height detection sensor S17.

Figure 16:
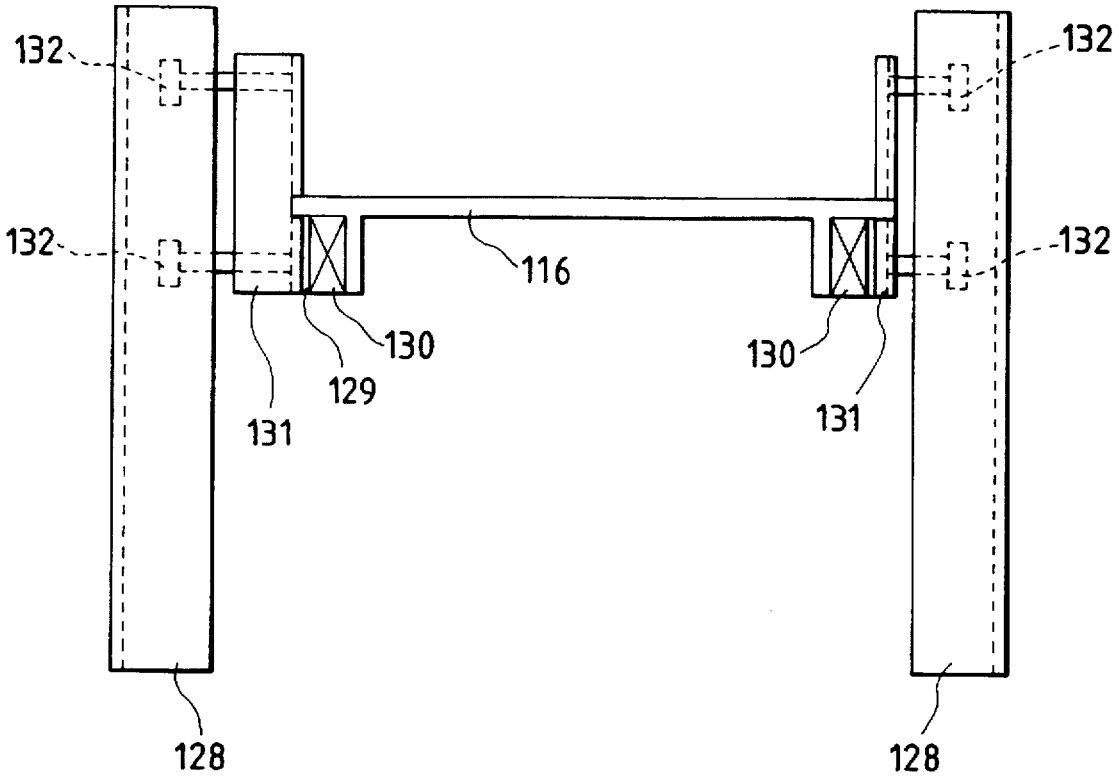
FIG. 16 is a front view showing a stack tray for the stack unit of FIG. 15.

Referring now to FIGS. 15 and 16, a stack tray 116 will be described below. FIG. 16 is a front view showing the stack tray of the stack unit of FIG. 15.

The stack unit 116 can be lifted or lowered within the stack frame 105, and drawn forwards by accurides 130 from a stack tray base board 129, as shown in FIGS. 15 and 16. On both end faces of the stack tray base board 129, roll receiving plates 131 of U-character shape are attached, each roll 132 provided on a roll receiving plate 131 being guided by a rail 128.

On the stack tray base board 129, a stack tray lifting motor M13 is attached. A drive force of the stack tray lifting motor M13 is transmitted via the gears 136, 137 to a through shaft 133. At both ends of the through shaft 133, pinion gears are secured, each pinion gear 134 being mated with a rack extending vertically to the corresponding guide rail 128. In this way, the stack tray base board 129 is moved vertically with the rotations of the through shaft 133 caused by the drive force of the stack tray lifting motor M13, while being guided by the guide rail 128. That is, the stack tray 116 is lifted or lowered by the drive force of the stack tray lifting motor M13.

Around an auxiliary shaft of the stack tray lifting motor M13, an encoder 138 is attached, wherein the number of rotations of the encoder can be read by the sensor S15. A detection signal from the sensor S15 is used to control the amount of lifting the stack tray 116.

The stack tray 116 has a copy paper detection sensor S30 attached to detect the sheet bundle stacked on the stack plane.

Figure 19:
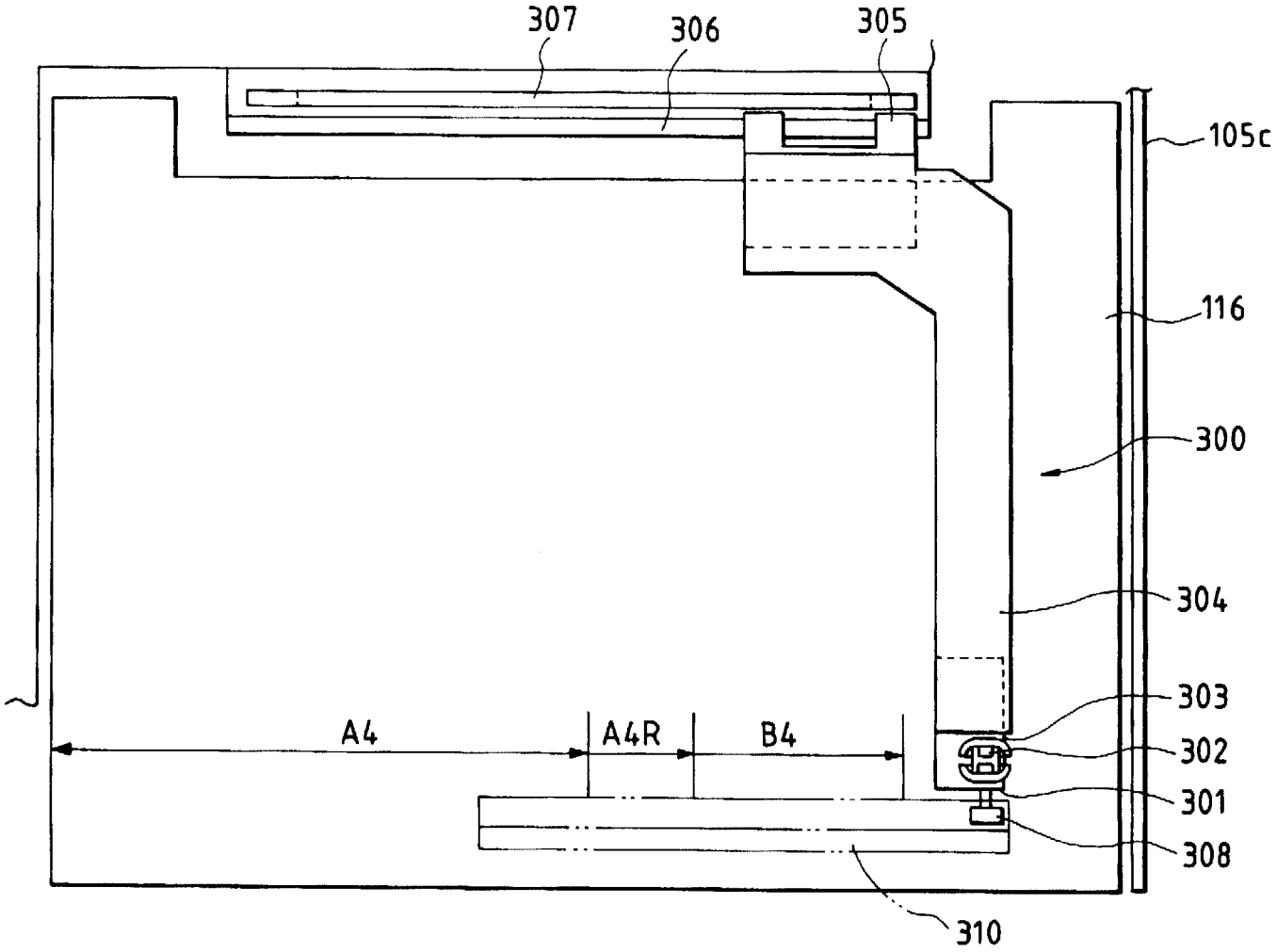
FIG. 19 is an upper view showing the constitution of a stopper for the stack unit of FIG. 15.
Figure 20:
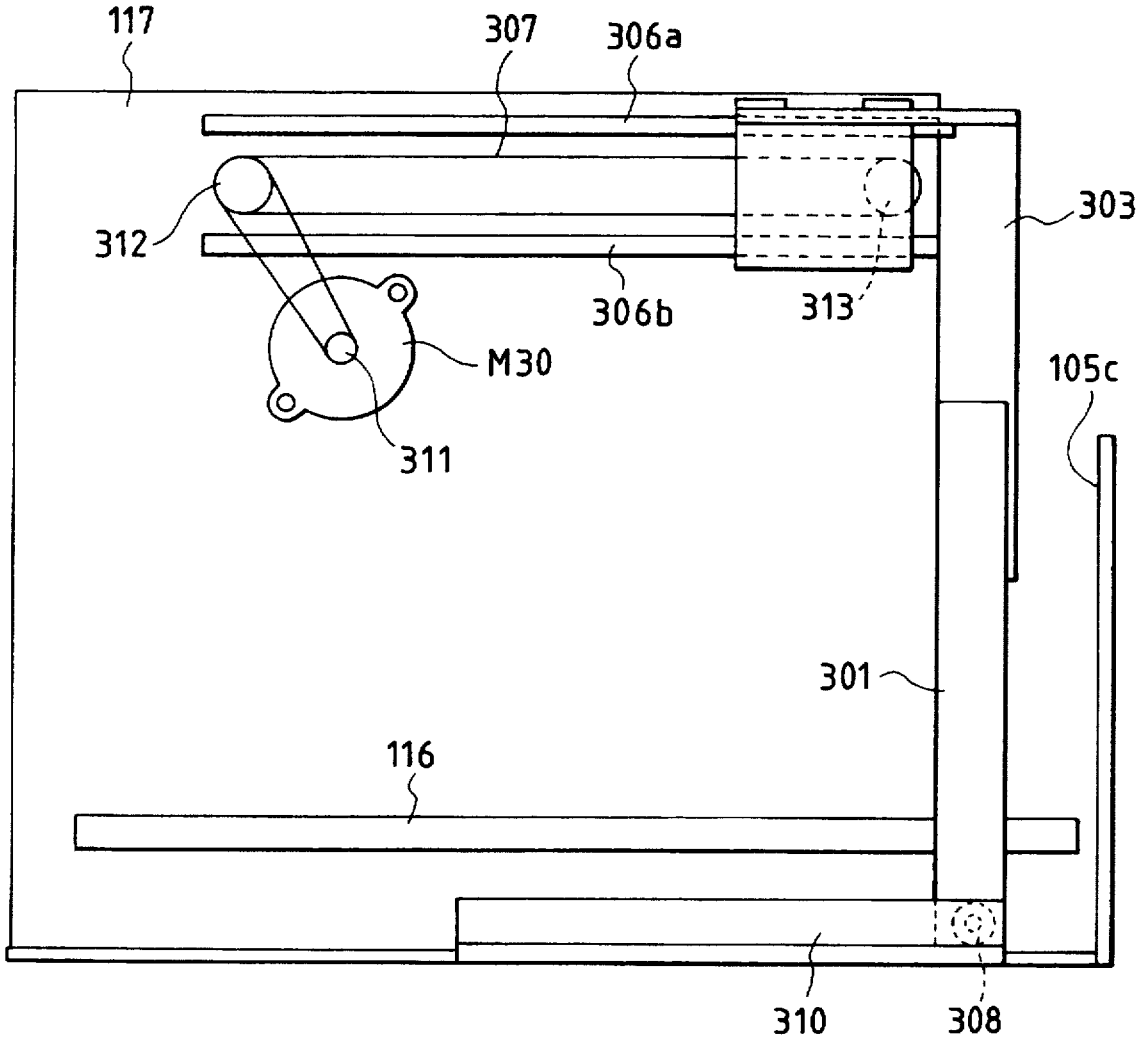
FIG. 20 is a front view showing the constitution of the stopper for the stack unit of FIG. 15.

Referring now to FIG. 15, FIG. 19 and FIG. 20, the constitution of a stopper 300 in the stack unit will be described below. FIG. 19 is an upper view showing the constitution of the stopper in the stack unit of FIG. 15, and FIG. 20 is a front view showing the constitution of the stopper in the stack unit of FIG. 15.

The stopper 300 constitutes a mechanism for preventing collapse of sheet bundle in the stack tray 116, in cooperation with the stacker reference wall 117, as shown in FIG. 15.

The stopper 300 has a securing member 301 vertically standing on the stack plane of the stack tray 116, and a moving member 303 movable in an axial direction of the securing member 301 while being guided by an accuride 302 provided on the securing member 301, as shown in FIGS. 19 and 20.

On the lower portion of the securing member 301, a roll 308, which is engaged in a rail member 310 for guiding in a direction orthogonal to the side plate 105*c* is attached. The rail member 310 is secured to a bottom plate 105*a*. On the contrary, one end of an arm 304 of L-character shape is attached at the top end of the moving member 303. The other end of this arm 304 is connected to a slider 305.

The slider 305 is supported by two shafts 306*a*, 306*b* extending parallel to an axial line of the rail member 310 to be movable in its axial direction. Both ends of each shaft 306*a*, 306*b* are fixed to the stacker reference wall 117.

The slider 305 has a belt 307 secured which is looped around a drive pulley 312 and a driven pulley 313. The drive pulley 312 has a drive force transmitted from the stopper moving motor M30 via an output pulley 311, and is rotated by this drive force. The slider 305 secured to the belt 307 is moved with the rotations of this drive pulley 312, while being guided by the shafts 306*a*, 306*b*. That is, the stopper 300 is moved along a guiding direction of the rail member 310, in parallel to the stack plane of the stack tray 116, with the movement of the slider 305.

The position of the stopper 300 parallel to the stack plane of the stack tray 116 is set in accordance with the size of sheet bundle stacked on the stack tray 116, wherein the positioning therefor can be made based on a detection signal from a reading sensor (not shown) of an encoder (not shown) of the stopper moving motor M30 and a detection signal from a home position sensor (not shown) for detecting the home position.

On the contrary, since the stopper moving motor M30, the drive pulley 312 and the driven pulley 313 are fixed to the stacker reference wall 117, the moving member 303 can be moved in a direction perpendicular to the stack plane of the stack tray 116, with the lifting operation of the stacker reference wall 117, its amount of movement being equal to the amount of lifting the stacker reference wall 117.

Figure 21:
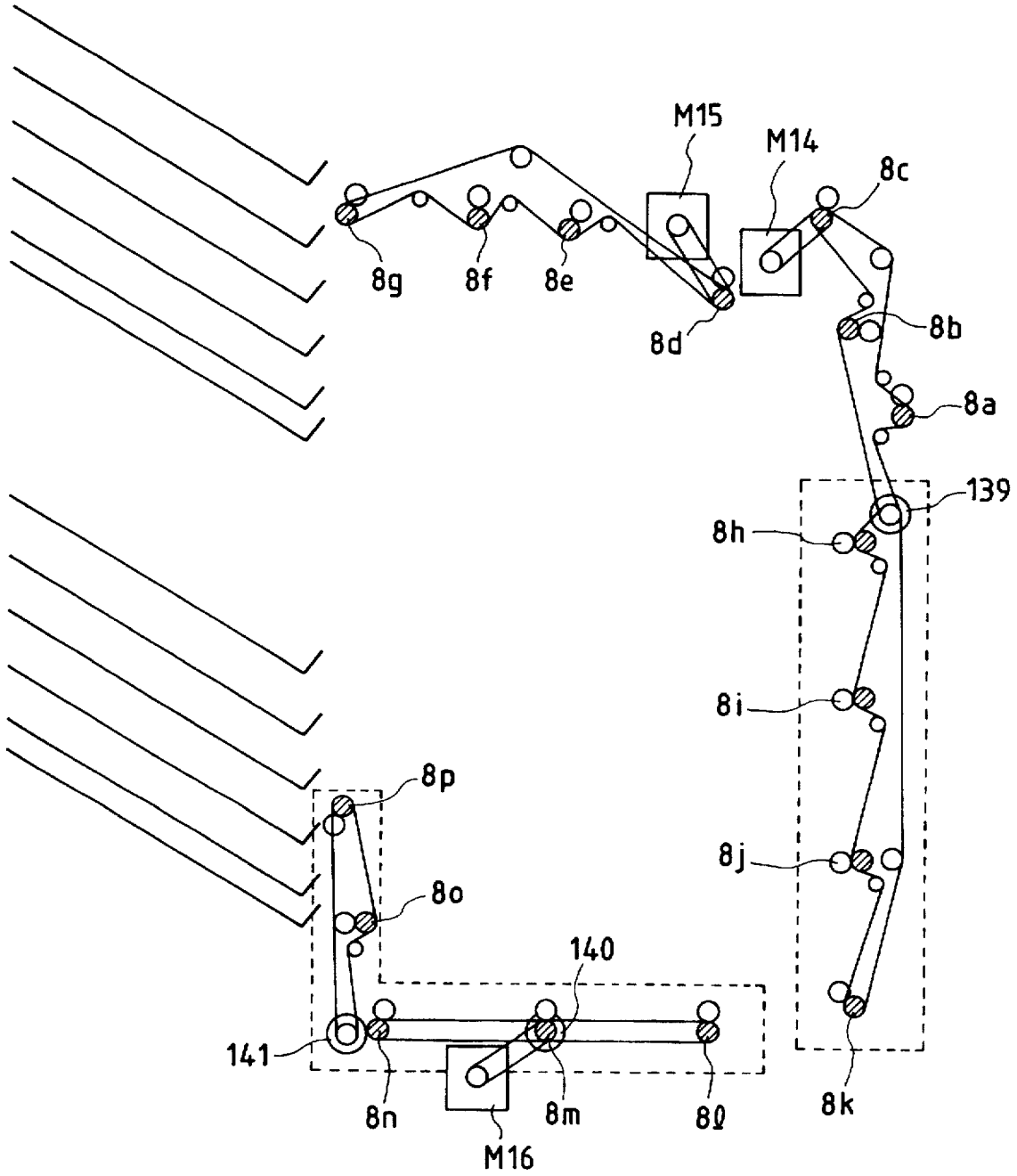
FIG. 21 is a longitudinal cross-sectional view showing a driving mechanism for a transport system in the staple/stack device of FIG. 1.

Referring now to FIG. 21, a drive mechanism of a conveying system for the staple/stack device 205 will be described below. FIG. 21 is a longitudinal cross-sectional view showing the drive mechanism of the conveying system for the staple/stack device of FIG. 1. Note that rollers indicated with the slant line within the pairs of rollers are on the driving side, while the other rollers are on the driven side in the figure.

This drive system is largely divided into three sections, each having a corresponding conveying motor M14, M15, M16 provided, as shown in FIG. 21.

First of all, the conveying motor M14 is responsible for driving roller pairs on the side closer to the copying machine main unit 201. Specifically, roller pairs 8*a*, 8*b*, 8*c* for conducting the sheet member to bin module B1 and the non-sort tray 5, and four roller pairs 8*h* to 8*k* for conducting the sheet member to bin module B2 are driven.

The conveying motor M15 is responsible for driving four roller pairs 8*d* to 8*g* on the side closer to a sheet ejector into the bin module B1.

Finally, the conveying motor M16 is responsible for driving five roller pairs 8*e* to 8*p* on the side closer to a sheet ejector into the bin module B2.

Note that since the portion surrounded by the broken line in the figure is drawn forwards in removing the jam as hereinafter described, respective couplings 139, 140 are provided to allow separation from the drive side. Also, in a section driven by the conveying motor M16, the roller pairs 8*e* to 8*n* have the lower rollers as the drive side, and the roller pairs 8*o* to 8*p* have the right rollers or upper rollers as the drive side, of which a gear 141 is provided to reverse the rotational direction.

Figure 22:
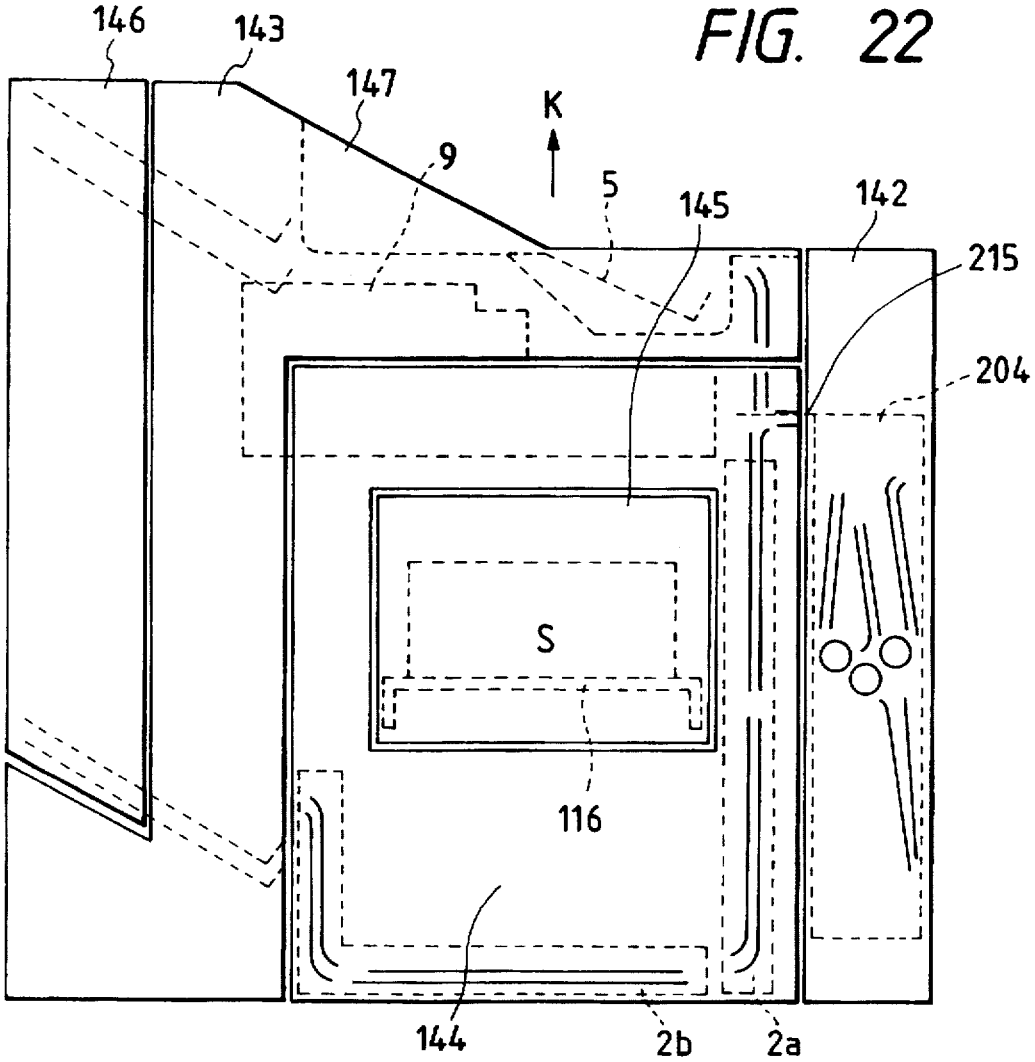
FIG. 22 is a front view showing the constitution of a cover for a sheet member post-processor of FIG. 1.

Referring now to FIG. 22, a cover configuration of a sheet member post-processor 203 will be described below. FIG. 22 is a front view showing the cover configuration of the sheet post-processor of FIG. 1.

A folder 204 is covered with a fold cover 142, as shown in FIG. 22. The staple/stack device 205 is provided with a fixed cover 143 for covering each bin module on the right side thereof in a longitudinal direction, a front cover 144 for covering the paths 2*a*, 2*b* leading to lower bin module and a part of the bundle process unit 9, a stack removal cover 145 for covering the stack tray 116 at a removable position and sheet bundle S on the stack tray 116, a bin cover 146 for covering each bin module on the left side thereof in the longitudinal direction, and an upper path cover 147. The upper path cover 147 has the non-sort tray 5, and forms an upper face of the path leading to the upper bin module. A fulcrum for rotation is provided on the rear side of the upper path cover 147, the upper path cover 147 being constructed to allow opening of its fore side upwards in a direction as indicated by the arrow K.

Figure 24:
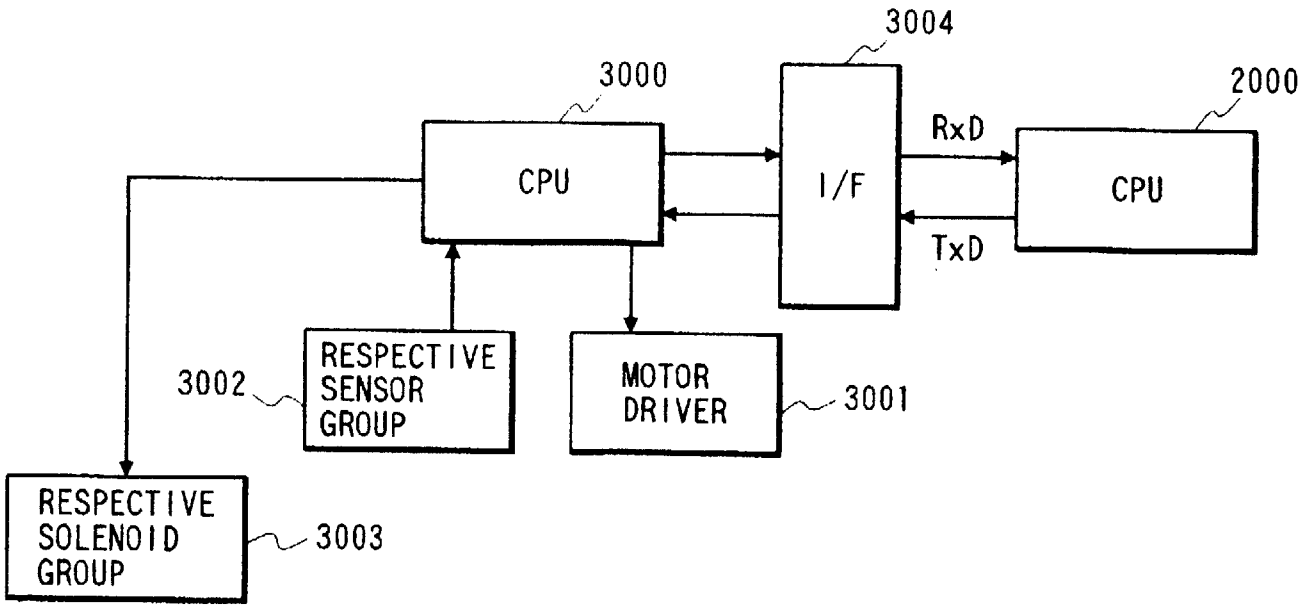
FIG. 24 is a block diagram showing the configuration of a control system for the electrophotographic copying machine of FIG. 1.

Referring now to FIG. 24, a control system for controlling the operation of the electrophotographic copying machine 200 will be described below. FIG. 24 is a block diagram showing the configuration of the control system in the electrophotographic copying machine of FIG. 1.

The control system for controlling the operation of the electrophotographic copying machine 200 is comprised of a CPU2000 mounted on the copying machine main unit 201, a CPU3000 mounted on the sheet member post-processor 203, and an I/F 3004 for enabling communication between the CPU2000 and the CPU3000, as shown in FIG. 24.

The CPU2000 controls the whole system of the copying machine main unit 201 and other units corresponding to a selected mode, as well as the operation of the automatic original feeder 202, and the instruction response to or from the sheet member post-processor 203. Specifically, the CPU2000 supervises the operation state of the copying machine main unit 201, the operation state of the automatic original feeder 202, and the operation state of the sheet member post-processor 203 which is informed from the CPU3000 via the I/F 3004, to provide direct control in accordance with the result of supervision, and send an instruction indicating the control content via the I/F 3004 to the CPU3000.

The CPU3000 controls the operation of a solenoid group 3003 for the sheet member post-processor 203, based on the instruction content informed from the CPU2000 via the I/F 3004 and a detection signal from respective sensor group 3002, as well as issuing a control instruction to motor driver 3001 for driving each motor under control.

The operation of this electrophotographic copying machine 200 will be described below.

The basic operation is first described.

First, originals are laid on an original tray 106 for automatic original feeder 202. Then, a predetermined mode condition is entered on an operation console (not shown), and a start key is depressed. Upon a depression signal of the start key, each section of sheet member post-processor 203 is controlled in a standby state. Each mode condition is described in the following.

(A) Non-sort mode

In FIG. 2, a deflector 3 is positioned in a sense of the solid line (downwards) and a deflector 4 is positioned in a sense of the broken line (downwards), wherein the conveying motor M14 (as shown in FIG. 19) is controlled to allow rotation of roller pairs 8*a*, 8*b*, 8*c* in the exhaust path 6.

A sheet exhausted from the copying machine main unit 201 after the end of image formation is passed along an upper path of folder 204 via a transport inlet port 215 into the staple/stack device 205. The sheet is deflected vertically upwards by the deflector 3, transported vertically upwards to the right of the deflector 4, and exhausted onto a non-sort tray 5 by a roller pair 8*c*.

(B) Sort mode

The operation at this sort mode is a typical sort mode operation, and described in the following.

First, in a standby operation, each deflector 3, 4 is positioned in a sense of the solid line. The upper and lower bin modules B1, B2 perform the bin shift operation so that the uppermost bins B11, B21 may be located opposed to the exhaust roller pairs 8*g*, 8*p*, respectively. An aligning wall 15 of each bin module B1, B2 waits at a home position corresponding to the width of sheet member. Regarding the driving of the bin stand portion, it is controlled to be stopped at a non-operation position.

The bundle process unit 9 is moved to a position of the upper bin module B1 corresponding to the removal of sheet bundle (broken line position of FIG. 2), and waits therein.

Each moving body within the bundle process unit 9 will be described below in connection with FIG. 7.

The first-out gripper 10 waits at a position as indicated in FIG. 7, and at this waiting position, has no interference with the sheet on the bin, in the lifting or lowering operation of the bin within the bin module located to the left of the bundle process unit 9.

The stapler 11 is moved to an escape position on the fore side, as indicated by the broken line in FIG. 7, without operation.

The transport gripper 12 waits at a position gripping substantially the central portion of sheet bundle transported by movement in the directions as indicated by the arrow F, as represented by the broken line in FIG. 7, and a position 12*a* capable of gripping the top end of sheet bundle taken first out by the first-out gripper 10 by movement in the direction as indicated by the arrow G.

The first-out gripper 10 and the transport gripper 12 wait at respective positions in a state where upper and lower grippers are opened.

Then, the stack unit 13 is moved to a position as indicated by the broken line in FIG. 2, to be able to accept the sheet bundle transported by the bundle process unit 9. In FIG. 17, regarding the stack tray 116 and the reference wall 117 within the stack unit 13, the upper face of the stack tray 116 is moved to a position capable of accepting the sheet bundle or any other position corresponding to the stack tray 116, and the stopper 300 of FIG. 19 is moved in accordance with the size of sheet bundle stacked on the stack tray 111.

The exhausted sheet member is passed through an upper path of the folder 204 to enter the transport inlet port 215, conducted along a path toward the bin module B1 by deflector 3, 4, and exhausted onto a bin B11 by the roller 8*g*.

After the completion of exhausting the sheet into the bin B11, the bin is shifted one bin upwards so that the bin B12 is raised up to a sheet receiving position. For each original, the above operation is repeated for storing the sheets into bins of the upper module B1. Thus, the upper module B1 is in the sheet receiving position for the lowermost bin (B16 in FIG. 2), and regarding the second sheet member, the sheets are received in succession from the lowermost bin.

After the above operation is repeated for all the originals, the receiving operation into the bins is ended.

In a sheet receiving end state, the sheet bundle transfer operation into the stacker is started. The first-out gripper 10 grips the sheet bundle on bin, after being moved in an open state from a position of the solid line to a position of the broken line as shown in FIG. 8. Then, an aligning portion Bj (bin stand portion) as shown in FIG. 6 is opened by a solenoid SL1, thereby forming a sheet transport opening.

The sheet bundle is transported to the right direction, while being regulated by reference poles 14*a*, 14*b* of FIG. 4 on the fore side, an aligning pole 15 on the rear side, and a guide member 53*a* of FIG. 7. And the first-out gripper 10 is stopped at the position of the solid line as shown in FIG. 8, where the sheet bundle is delivered from the first-out gripper 10 to the transport gripper 12.

Figure 23:
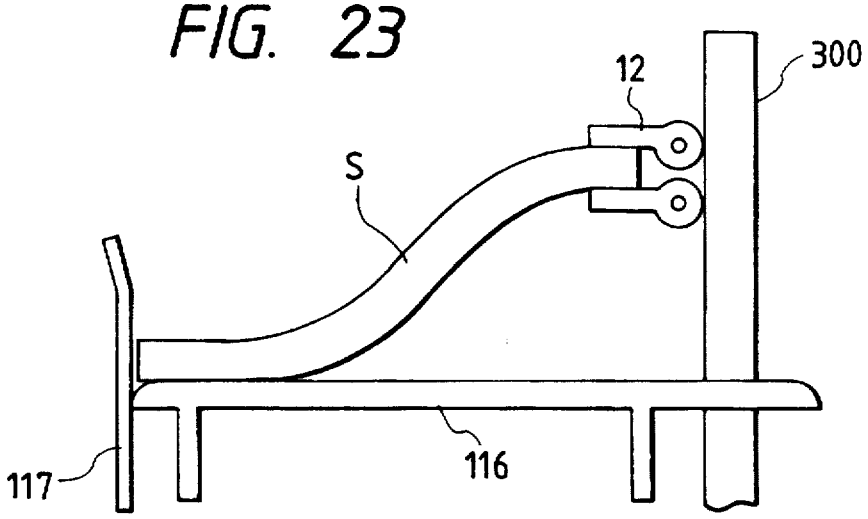
FIG. 23 is a view showing a state of transporting a sheet bundle into the stack unit of FIG. 15.

In this delivery, the transport gripper 12, waiting in the open state at the position of the broken line in FIG. 7, grips the almost central portion of sheet bundle. Then, the first-out gripper 10 releases the sheet bundle, and prepares for the transport of the next bundle. The transport gripper 12 is driven in the right direction as indicated by the arrow G in FIG. 7 to transport the sheet bundle to the right, and stopped at a proper position in accordance with the size. In this state, the trailing end of the sheet bundle S falls on the upper face of the stack tray 116, as shown in FIG. 23, with the left side regulated by the stacker reference wall 117. From this state, the transport gripper 12 is opened to also allow the top end portion of sheet bundle to fall on the stack tray 116. Then, the right end of sheet bundle S is regulated by the stopper 300.

Then, when performing the sheet bundle transport for the second bundle, because the operation from the transport gripper 12 gripping the substantially central portion of sheet bundle to the delivery of sheet bundle between grippers is the same as that of the first bundle, the following operation is only described.

After the delivery of sheet bundle, the transport gripper 12 is moved by a predetermined amount in the directions as indicated by the arrow F in FIG. 7. Owing to this movement, discrimination from the first sheet bundle is enabled, when stacking on the stack tray 116.

The sheet bundle stacked on the stack tray 116 is controlled in such a manner that its uppermost face is detected by a sensor S23 at all times, and the stack tray 116 is gradually lowered so that the interval between the bundle process unit 9 located upward and the uppermost face of stack may be always constant.

Also, the sheet bundle on the stack tray 116 can be arbitrarily taken out, when the stack unit 13 is not in operation. Specifically, by the operator depressing a removal bottom (not shown), the stack unit 13 is moved to a removal position, and a stack removal door 145 can be opened or closed.

By closing the cover after taking out the sheet bundle, the operation is continuously allowed.

(C) Staple sort mode

The transport of the sheet and sheet bundle is the same as in the case of the above sort mode, and no more described. Herein, the movement control of the stapler is described below.

The stapler 11 can be arbitrarily stopped between the escape position 11*a* on the fore side and the escape position 11*b* on the rear side, as shown in FIG. 7 and FIG. 13.

(c-i) Stapling of one site on the fore side

In the above non-staple mode, the stapler 11 is in the escape position 11*b* on the fore side, while in selecting the stapling mode of one site on the fore side, the stapler 11 waits at position 11*c*, as shown in FIG. 7 and FIG. 13. As will be clear from FIG. 7, the stapler 11, even in position 11*c*, can wait without interference with the transport gripper 12 lying at position 12*a*. The stapler 11, after performing the stapling operation for the sheet bundle transported by the first-out gripper 10, is moved to the escape position 11*a* on the fore side. Then, the sheet bundle stapled is transported to the right by the transport gripper 12.

If the trailing end of the sheet bundle gets out of the movement area of the stapler 11, the stapler 11 is moved again to the position 11*c* for stapling one site to wait for the next sheet bundle to be accepted.

(c-ii) Stapling of two sites

Also in this case, the stapler 11, whether in a position 11*d* or 11*e*, has no interference with the position 12*a* of the transport gripper 12, as shown in FIG. 7. In a standby state of stapling two sites, the stapler 11 is moved from the escape position 11*a* on the fore side to the driving position 11*d* two sites forward, and waits therein.

If the sheet bundle is transported by the gripper 10, the stapler 11 staples one site on the fore side for the sheet bundle gripped by the first-out gripper 10 at the position 11*d*, and subsequently, the stapler 11 is moved to the position 11*e* to staple another site on the rear side for the sheet bundle gripped by the first-out gripper 10. If the stapler 11 is moved from the position 11*d* to the position 11*e*, the transport gripper 12 starts to enter from a wait position 12*b* into a position 12*a* gripping the sheet bundle. After the transport gripper 12 grips the sheet bundle, and the first-out gripper 10 releases the sheet bundle.

On the contrary, the stapler 11, after stapling the second site at the position 11*e*, is moved to the escape position 11*b* on the rear side. If the trailing end of sheet bundle for the first bundle gets out of the staple movement area, the stapler 11 is moved to the position 11*e* to accept the sheets for the second bundle.

(c-iii) Stapling of one site on the rear side

This is a case of stapling one site on the rear side from the center of paper size, and thus an opposite operation of the above-described (c-i), such that the stapler 11 is reciprocated between the escape position 11*b* on the rear side and the stapling position.

(D) Fold mode

In a fold mode, a relatively long sheet in the transport direction is folded by a folder 204 (as shown in FIG. 2), and the folded sheet is exhausted onto the bin, in the same way as the normal sheet, selectively post-processed, and stacked on the stack unit 13.

However, for the folded sheet, in particular, a so-called Z-fold having a folded portion at the center of the sheet in the transport direction or at the slightly downstream side from the center in the transport direction, or a C-fold for folding the legal size which is an overseas size into letter size, the top end of folded paper exhausted, when stacked on the bin, strikes against the folded portion of folded paper already stacked, with the risk of disordering the alignment of sheets already stacked, due to slipping, or causing the exhausted folded sheets to be incorrectly stacked. To solve such nonconformity, the uppermost bin is lowered below the normal sheet exhaust position, to store the folded sheets only into the uppermost bin under control.

Referring now to FIGS. 25 to 34, the control operation in this embodiment will be described below. FIGS. 25 to 34 are flowcharts showing the control operation of the sheet member post-processor of FIG. 1.

First, a mode process which is a whole process of the sheet member post-processor 203 will be described below.

Figure 25:
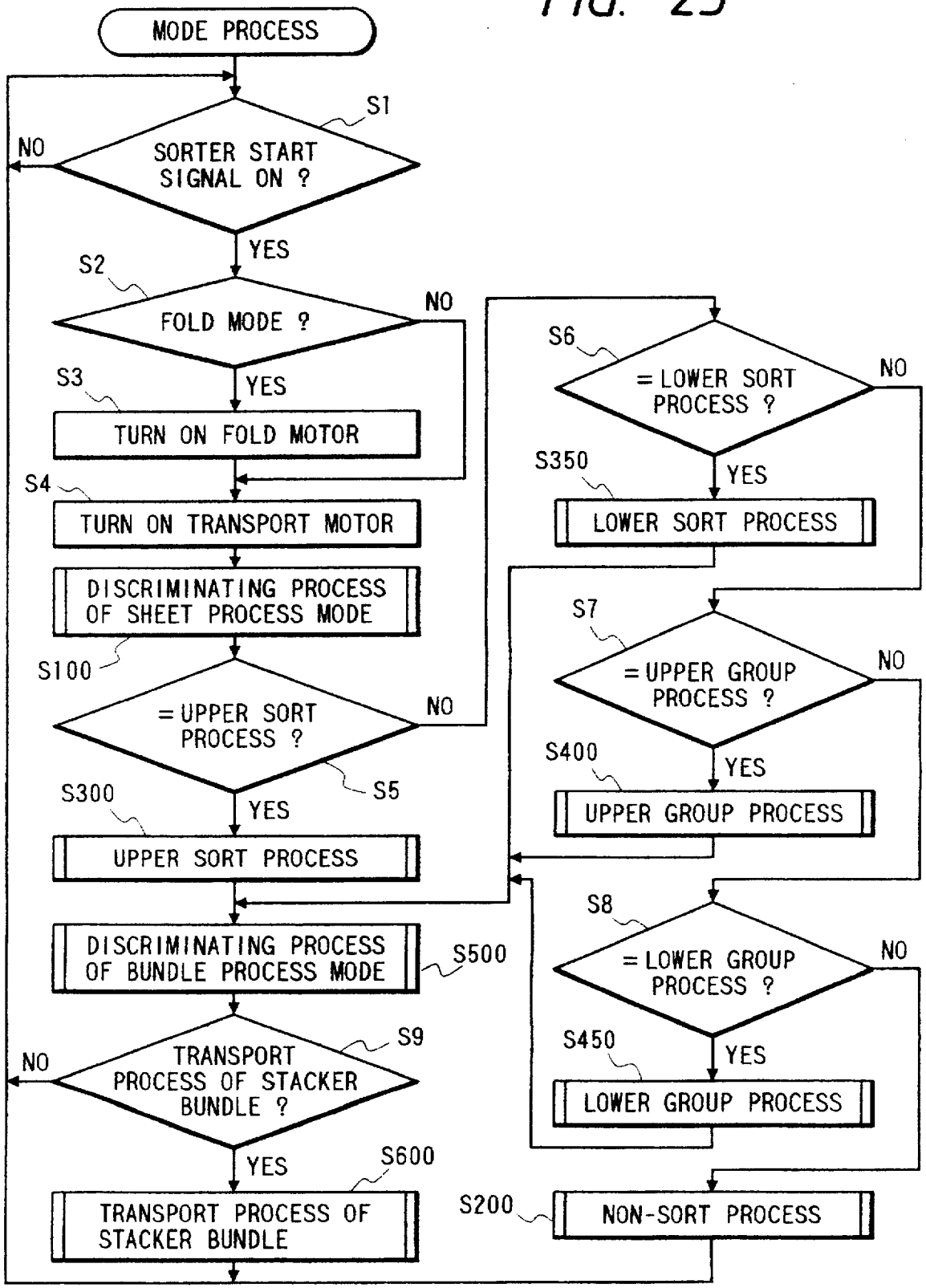
FIG. 25 is a flowchart showing the control operation of the sheet member post-processor of FIG. 1.

Referring to FIG. 25, upon starting the mode process, at step S1, a determination is made whether or not a sorter start signal indicating that the exhausting of sheets from the copying machine main unit 201 is started has been output.

If the sorter start signal is on, a determination is made at step S2 whether or not the fold mode is selected as the operation mode, wherein if the fold mode is selected, step S3 is executed, or otherwise step S4 is executed.

At step S3, the fold motor is turned on, and subsequently at step S4, the whole transport motor is turned on.

Subsequently, at step S100, a sheet process mode discriminating process for discriminating the stacking/storing of sheet onto the non-sort tray/bin portion for the finisher is performed. The details of this sheet process mode discriminating process will be described later.

The sheet process mode indicated by the result of discrimination by the sheet process mode discriminating process is determined at steps S5, S6, S7, and S8, and in accordance with the result of discrimination, the operation transfers to any of an upper sort process (step S350), a lower sort process (step S350), an upper group process (step S400), a lower group process (step S450), and a non-sort process (step S200) to execute its process. The details of each process will be described later.

After execution of the upper sort process (step S300), the lower sort process (step S350), the upper group process (step S400) or the lower group process (step S450), at step S500, a bundle process mode discriminating process is executed to determine whether or not the sheet transport operation to the bundle process unit/stack unit 13 is performed. The details of this bundle process mode discriminating process will be described below.

Then, at step S9, a determination regarding the result of discrimination by the bundle process mode discriminating process is made, wherein if the result of discrimination by the bundle process mode discriminating process indicates selection of bundle transport process by the bundle process unit 9, at step S600 is executed, or if the result of discrimination by the bundle process mode discriminating process indicates no selection of bundle transport process by the bundle process unit 9, the operation returns to step S1 again.

At step S600, a stacker bundle transport process for transporting the sheet bundle to the bundle process unit/stack unit 13 is performed. This stacker bundle transport process includes a staple operation for the sheet bundle, and the details of the stacker bundle transport process will be described later.

After execution of step S600, the operation returns to step S1 again to wait for a sorter start signal to be subsequently output from the copying machine main unit.

Then, the sheet process mode discriminating process (step S100) will be described with reference to FIG. 26.

Figure 26:
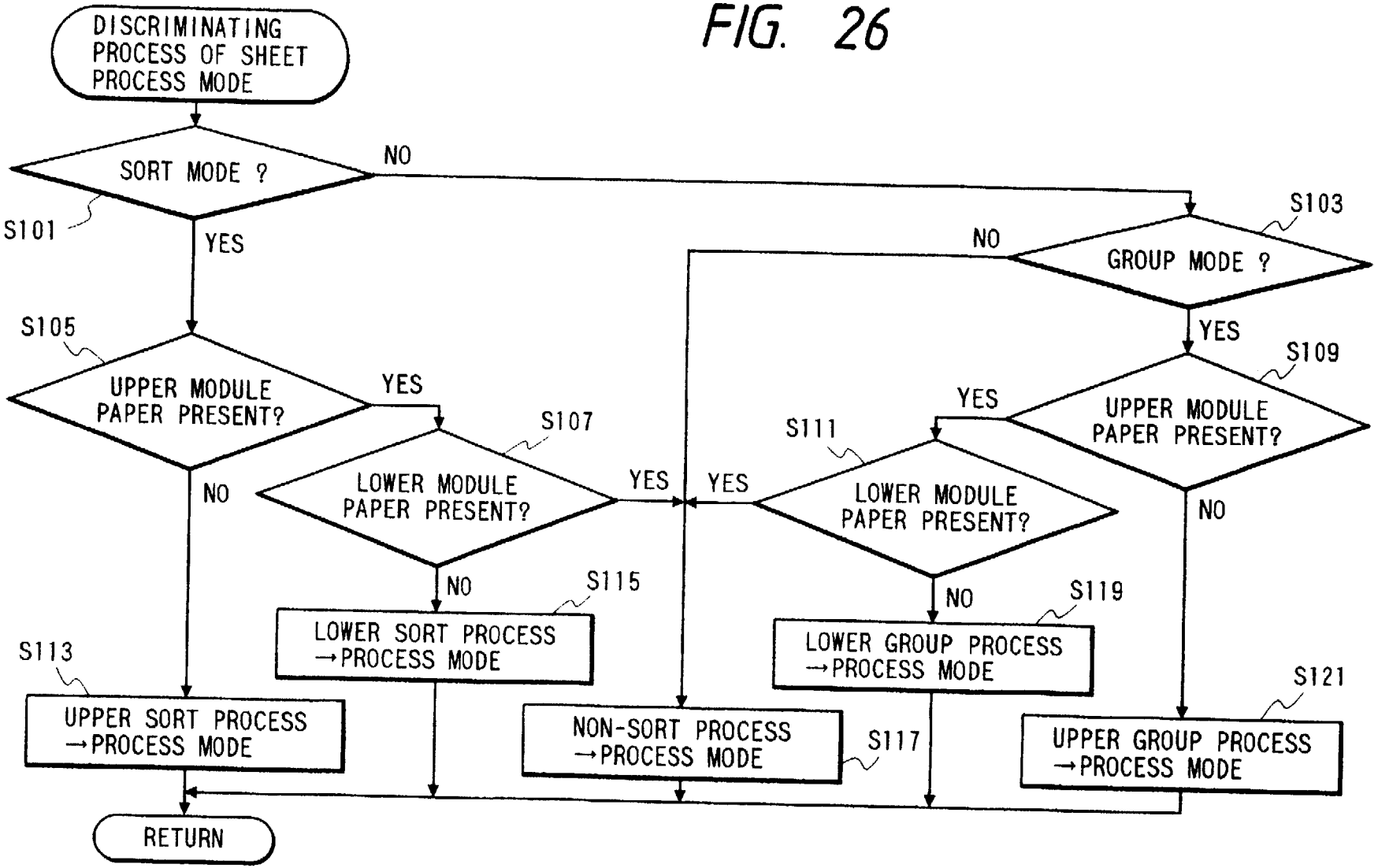
FIG. 26 is a flowchart showing the control operation of the sheet member post-processor of FIG. 1.

Referring to FIG. 26, first, step S101 is executed to determine whether or not the sheet process mode is a sort mode.

If the sheet process mode is the sort mode, at steps S105, S107, a determination is made whether or not any sheet is present in the upper and lower bin modules B1, B2, and at steps S113, S115, the sort process in the bin module having no sheet is selected as the process mode. On the contrary, if any sheet is present in upper and lower bin modules, a non-sort mode is selected as the process mode at step S117.

If the sheet process mode is not the sort mode, a determination is made whether or not the sheet process mode is a group mode at step S103. If the sheet process mode is the group mode, at steps S109, S111, a determination is made whether or not the sheet is present in upper and lower bin modules B1, B2, in the same way as in the process after determination for the sort mode, and at steps S119, S121, the group process in the bin module having no sheet is selected as the process mode. On the contrary, if a sheet is present in upper and lower bin modules, the non-sort process is selected as the process mode at step S117.

Then, the non-sort process (step S200) will be described below with reference to FIG. 27.

Figure 27:
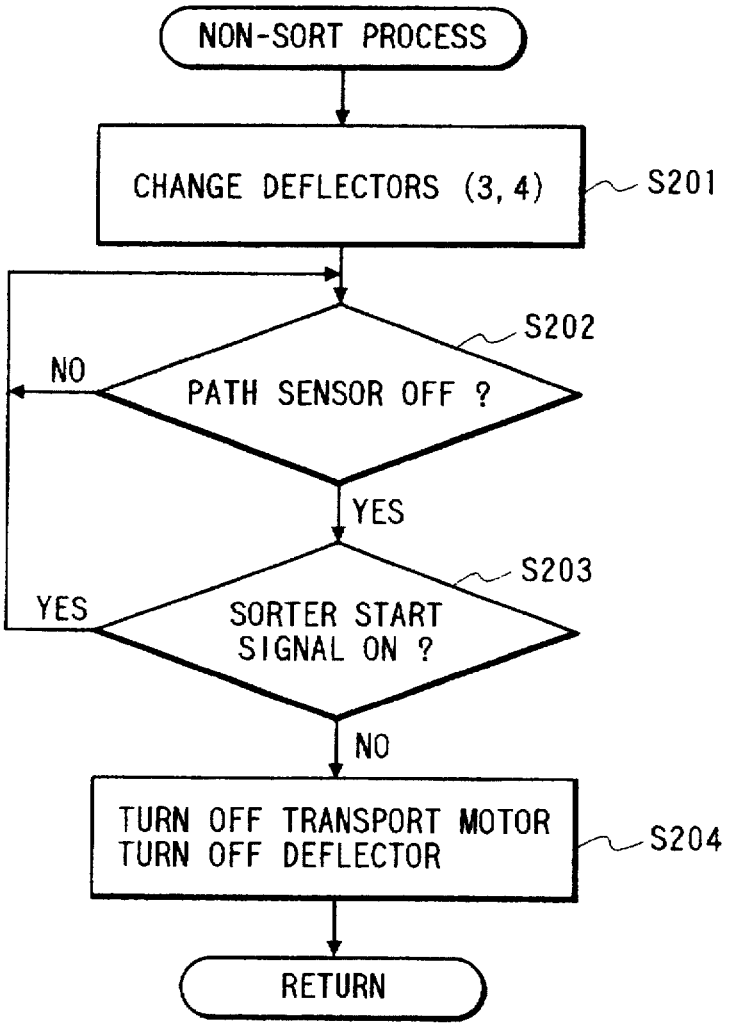
FIG. 27 is a flowchart showing the control operation of the sheet member post-processor of FIG. 1.

If the non-sort process is selected, step S201 is executed to change each of deflectors 3, 4 to continuously exhaust the sheet into the non-sort tray 5, and select a sheet transport path 6 as the transport path, as shown in FIG. 27.

Then, step S202 is executed to monitor a signal of a path sensor (not shown) disposed near the exhaust roller 8c on the sheet transport path 6 to monitor the sheet transport operation. Subsequently, at step S203, a determination is made whether or not a sorter start signal indicating the in-operation of sheet exhaust from the copying machine main unit is present.

If it is determined at steps S202, S207 that the path sensor is off and the sorter start signal is on, step S204 is executed to stop the transport motor and turn off the solenoid for driving the deflectors 3, 4. After execution of step S204, the non-sort process is ended.

The upper sort process (step S300) will be described below with reference to FIG. 28.

Figure 28:
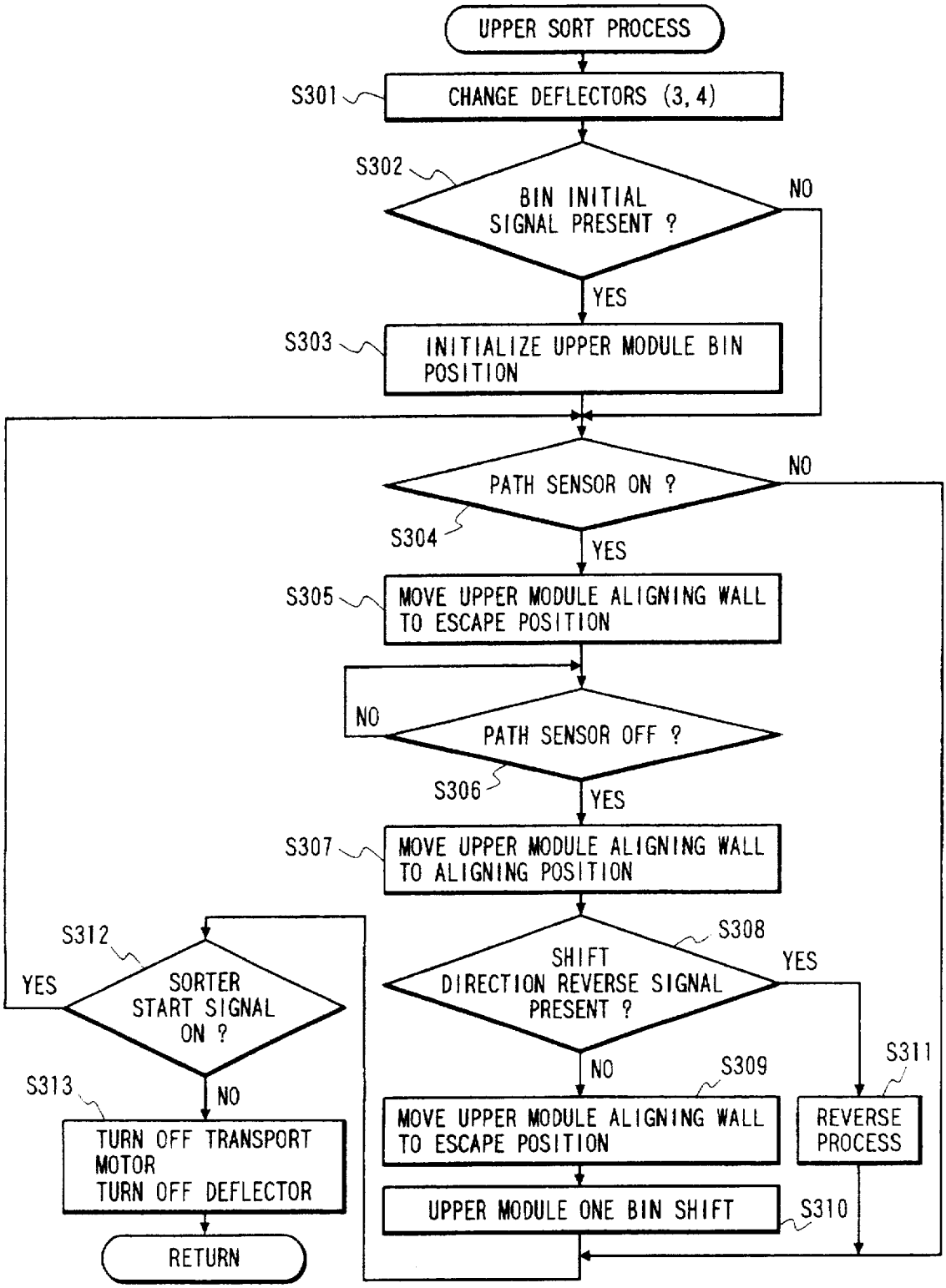
FIG. 28 is a flowchart showing the control operation of the sheet member post-processor of FIG. 1.

Referring to FIG. 28, first, at step S301, the deflectors 3, 4 are changed to store and classify the sheet into the upper bin module B1 to select a sheet transport path as the transport path.

At next step S302, a determination is made whether or not a bin initial signal to store the sheets from the uppermost bin is present, wherein if the bin initial signal is present, step S303 is executed, or otherwise step S304 is executed.

At step S303, the uppermost bin is lowered to the position of pair rollers 8g, as the initialization of bin, and at step S304, a signal from a path sensor (not shown) disposed near a pair of rollers 8g on the sheet transport path 7 is monitored to monitor the sheet transport operation. At step S304, if the signal from the path sensor is not present, step S312 is executed, or otherwise step S305 is executed.

At step S305, the aligning wall 15 is escaped as the preparation for aligning the exhausted sheets which will be performed later.

At the next step S306, if an off signal from the path sensor is detected, step S307 is executed to move the aligning wall 15 to an aligning position for the aligning operation for the sheet bundle that has been exhausted onto the bin.

Subsequently, at step S308, a determination is made whether or not a shift direction reverse signal is present, wherein if the shift direction reverse signal is present, step S311 is executed, or otherwise steps S309 and S310 are executed in succession.

At step S309, the aligning wall 15 is moved to an escape position, and then at step S310, the upper module is shifted one bin.

On the contrary, at step S311, the reverse process is performed. This reverse process means to reverse the bin shift direction after this time, without bin shift operation.

After execution of step S310 or step S311, step S312 is executed to determine whether or not the sorter start signal is on. If the sorter start signal is on, the process returns to step S304, while if the sorter start signal is off, the transport motor is stopped, and the solenoid of deflector is turned off at step S313, thereby ending the sort process.

Next, the lower sort process (step S350) will be described below with reference to FIG. 29.

Figure 29:
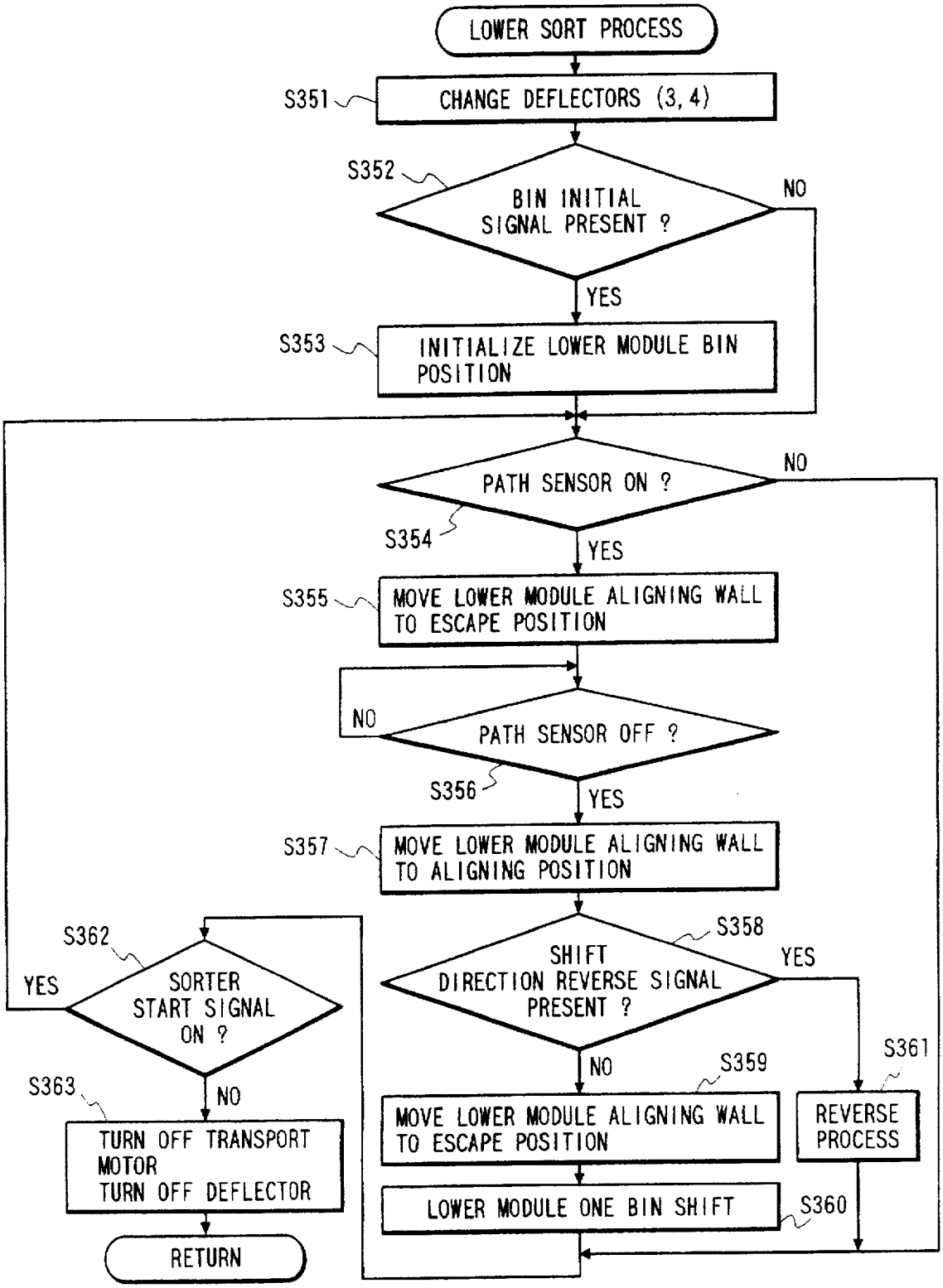
FIG. 29 is a flowchart showing the control operation of the sheet member post-processor of FIG. 1.

If the lower sort process is selected, first, step S351 is executed to change the deflector 3 to store and classify the sheet into the lower bin module 1B2 to select a second transport path 2 as the transport path, as shown in FIG. 29. Then, the processings following step S352 are executed, but are the same as those following step S302 in the above-described upper sort process, and no more will be described herein.

Next, the upper group process (step S400) will be described blow with reference to FIG. 30.

Figure 30:
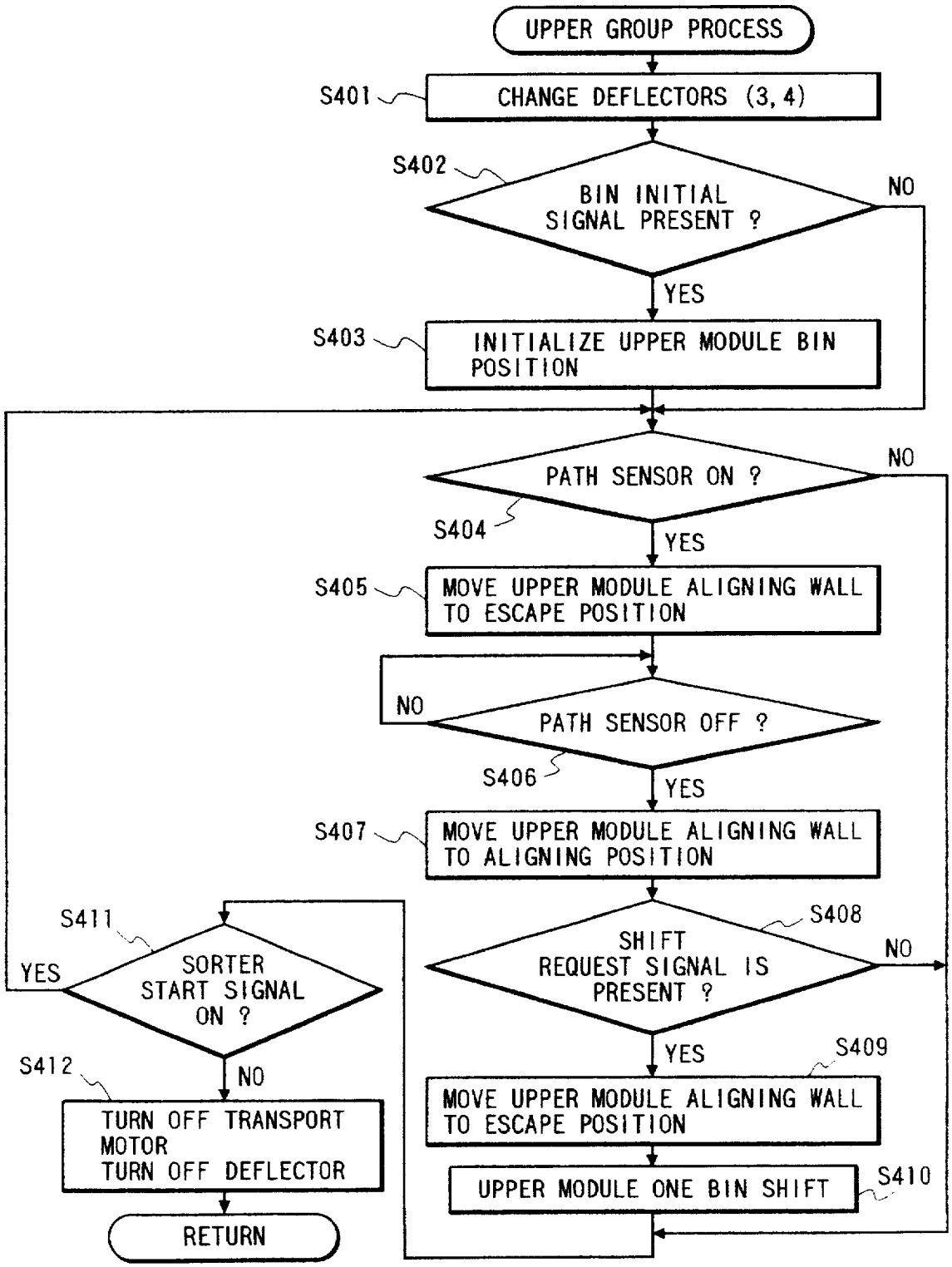
FIG. 30 is a flowchart showing the control operation of the sheet member post-processor of FIG. 1.

Referring to FIG. 30, first, at step S401, the deflectors 3, 4 are changed to store and classify the sheet into the bin of the upper bin module B1 to select a sheet transport path 7 as the transport path.

At next step S402, a determination is made whether or not a bin initial signal to store the sheets from the uppermost bin is present, wherein if the bin initial signal is not present, step S404 is executed, or otherwise step S403 is executed.

At step S403, the uppermost bin is lowered to the position of pair rollers 8g, as the initialization of bin. Then, at step S404, a signal from a path sensor disposed near pair rollers 8g on the sheet transport path 7 is monitored to monitor the sheet transport operation. If the signal from the path sensor is off, step S411 is executed, or otherwise step S405 is executed.

At step S405, the aligning wall 15 is escaped to the escape position as the preparation for aligning the exhausted sheets which will be performed later.

At the next step S406, if an off signal from the path sensor is detected, step S407 is executed to move the aligning wall 15 to the aligning position for the aligning operation for the sheet bundle on the bin.

Subsequently, at step S408, a determination is made whether or not a shift request signal of requesting the shift operation of bin is present, wherein if the shift request signal is not present, step S411 is executed. If the shift request signal is present, steps S409 and S410 are executed in succession, wherein the aligning wall 15 is escaped to the escape position at step S409 and the upper module is shifted one bin at the next step S410.

Then, at step S411, a determination is made whether or not the sorter start signal is on, wherein if the sorter start signal is on, the process returns to step S404, while if the sorter start signal is off, step S412 is executed to stop the transport motor, and turn off the solenoid of deflector. After execution of step S412, the upper group process is ended.

Next, the lower group process (step S450) will be described below with reference to FIG. 31.

Figure 31:
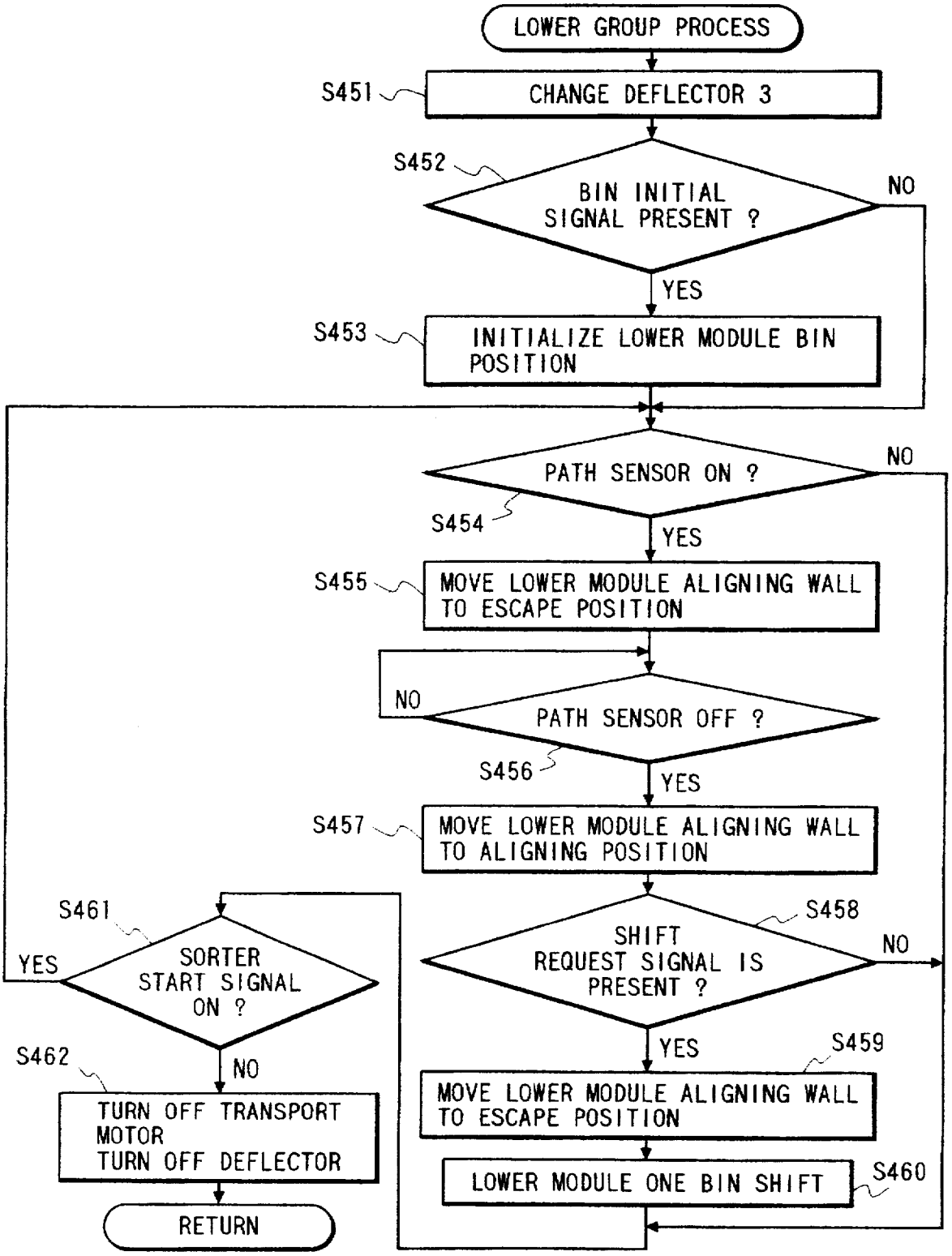
FIG. 31 is a flowchart showing the control operation of the sheet member post-processor of FIG. 1.

If the lower group process is selected, first, step S451 is first executed to change the deflector 3 to store and classify the sheet into the bin of the lower bin module B2 to select the second transport path 2 as the transport path, as shown in FIG. 31. Then, step S452 is executed, but the processings following step S452 are the same as those following step S402 in the above-described upper group process, and no more described herein.

Next, the bundle process mode discriminating process (step S500) will be described below with reference to FIG. 32.

Figure 32:
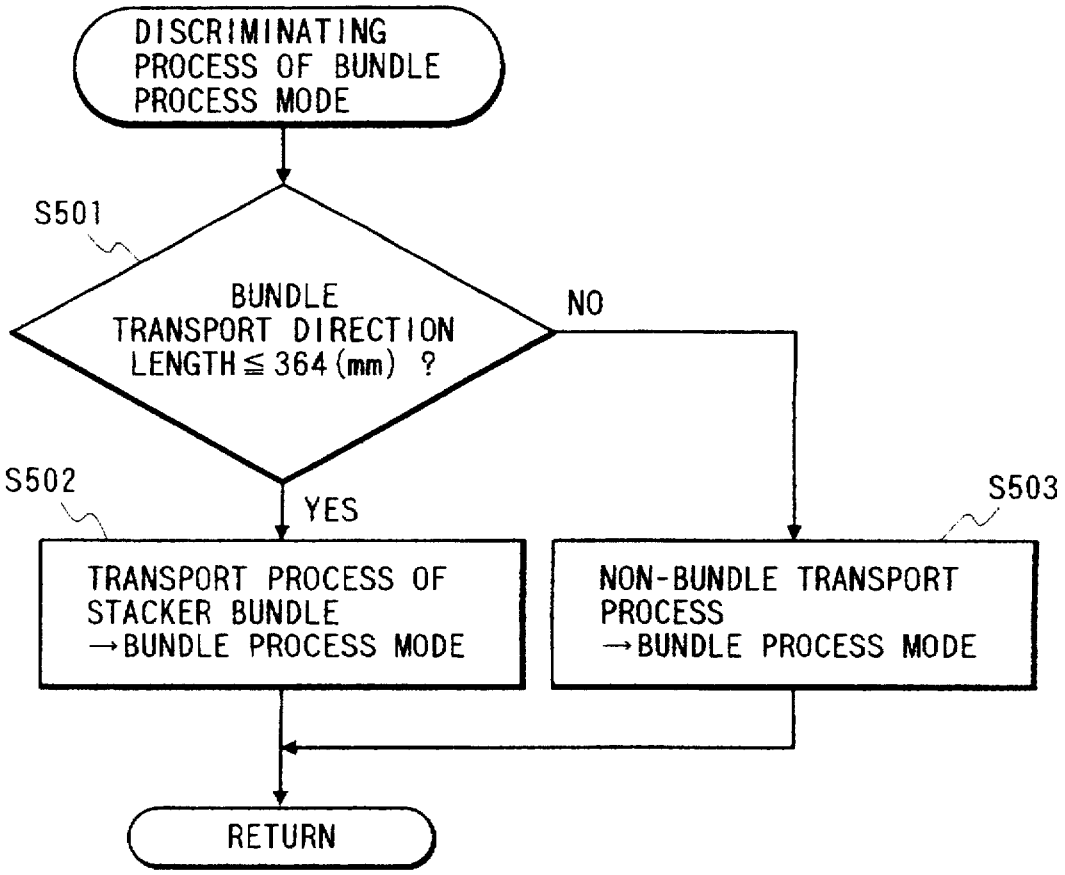
FIG. 32 is a flowchart showing the control operation of the sheet member post-processor of FIG. 1.

Referring to FIG. 32, first, at step S501, a determination is made whether or not the sheet length in a bundle transport direction is longer than a predefined value (e.g., 364 mm).

If the sheet length in the bundle transport direction is longer than the predefined value, a non-bundle transport process is selected as the bundle process mode at step S503, because the sheet bundle can not be stored within the bundle process unit 9 and stack unit 13, or if the sheet length in the bundle transport direction is within the predefined value, a stacker bundle transport process is selected at step S502. Note that the non-bundle transport process means not to transport the bundle into the bundle process unit 9 and stack unit 13, so that the sheet bundle on the bin remains on the bin. The stacker bundle transport process is to transport each sheet bundle exhausted into the bin to stack within the stack unit 13.

Next, the stacker bundle transport process will be described below with reference to FIG. 33.

Figure 33:
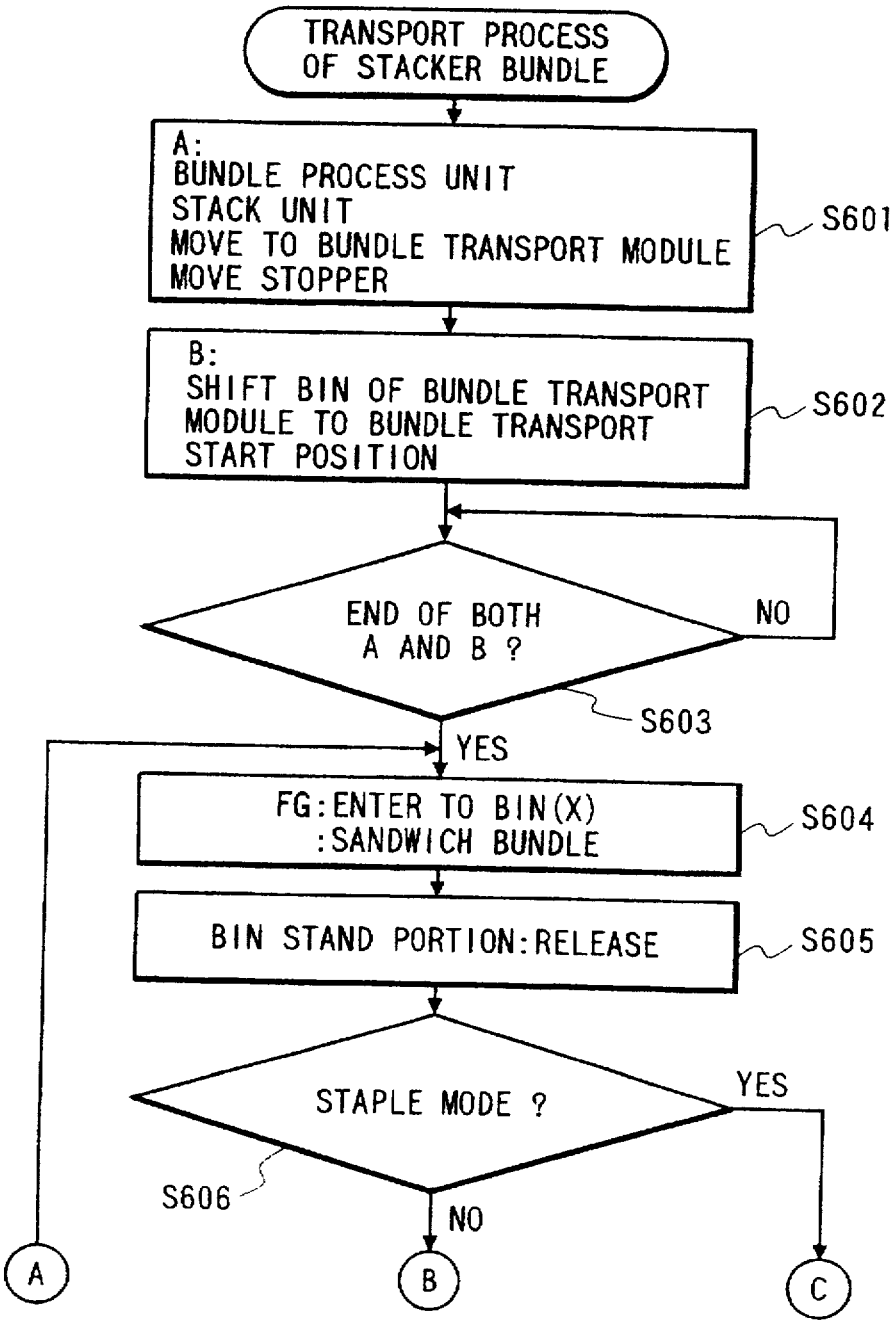
FIG. 33 is a flowchart showing the control operation of the sheet member post-processor of FIG. 1.
Figure 34:
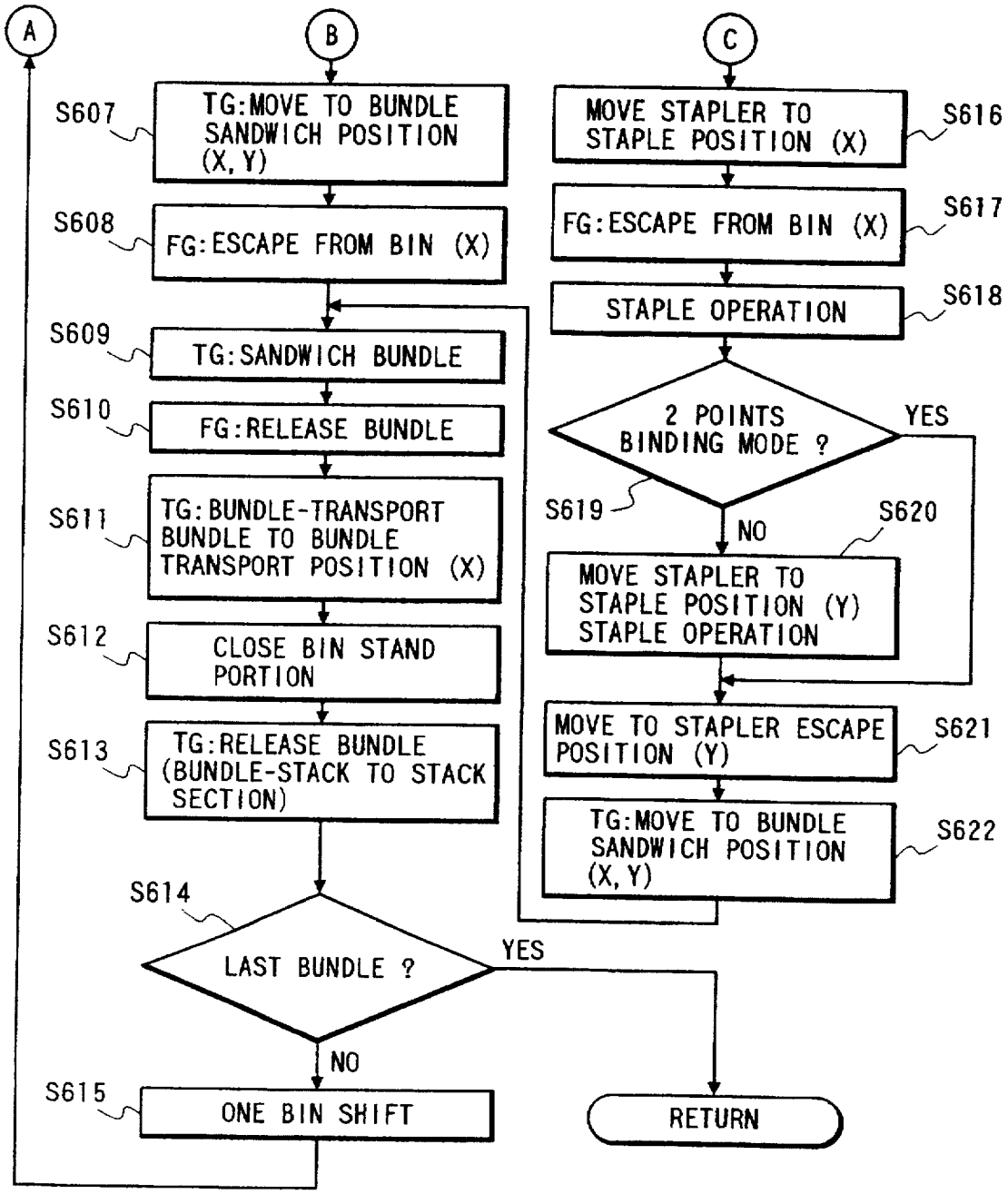
FIG. 34 is a flowchart showing the control operation of the sheet member post-processor of FIG. 1.

If this stacker bundle transport process is selected, first, step S601 is executed to start a process A, as shown in FIG. 33. In this process A, the bundle process unit 9 and the stack unit 13 are moved to a bin module position for transporting the bundle, and the stopper 300 is moved to a position corresponding to the sheet size.

At next step S602, a process B is started. In this process B, the bin shift to the position for transporting the bundle is performed, so that the uppermost or lowermost bin among the bins in use is in the position for transporting the bundle. Also, after end of the shift, if the upper bin of the bins in use is in the position for transporting the bundle, the subsequent shift direction is set downward, while if the lower bin of the bins in use is in the position for transporting the bundle, the subsequent shift direction is set upward.

The process A and process B can be executed at the same time to shorten the processing time.

Then, step S603 is executed to wait for the end of both process A and process B.

If the process A and process B are ended, step S604 is executed. At step S604, the first-out gripper 10 (hereinafter referred to as FG) is moved in an X direction to enter into the bin, and sandwiches the bundle with FG. Herein, (X), (Y) and (Z) in the flowchart indicate the moving direction of moving member, wherein (X) indicates the transport direction (left and right) of the sheet bundle, (Y) indicates the fore to rear direction, as looked from the front face of finisher, and (Z) indicates the upper to lower direction.

At the next step S605, the bin stand portion is released to transport the bundle from the bin to open the sheet transport inlet port. Then, the bundle is gripped by FG, and does not drop.

Then, at step S606, a determination is made whether or not the stapler mode is included. If the staple mode is included, step S616 is executed, or otherwise, step S607 is executed.

At step S607, the transport gripper (hereinafter referred to as TG) 12 for transporting the bundle is moved to a bundle delivery position from FG, and at step S608, FG is escaped from the bin to the bundle delivery position.

At next step S609, the sheet bundle sandwiched by FG is delivered to and sandwiched by TG at the bundle delivery position. If TG sandwiches the sheet bundle, the sheet bundle is released by FG for the delivery at step S610.

Then, at step S611, the bundle is transported by the movement to a bundle stack position of TG, and at step S612, the bin stand portion is closed.

If TG is stopped at the bundle stack position, step S613 is executed for TG to release the bundle, thereby stacking the bundle onto the stack unit 13.

Then, at step S614, a determination is made whether or not the sheet bundle stacked is the last bundle of corresponding bin modules. If not the last bundle, the one bin shift occurs in a shift direction set at step S615, and the operation returns to step S604 again. On the contrary, if the last bundle, the bundle transport operation for the corresponding module is ended.

On the contrary, if the staple mode is included at step S606, step S616 is executed to move the stapler 11 to a corresponding staple position, and at next step S617, the bundle is moved from the bin to its staple position. If the sheet bundle is moved to the staple position, the staple operation is performed at step S618.

Subsequently, at step S619, a determination is made whether or not the staple mode is a two-point binding mode, and if the staple mode is the two-point binding mode, the stapler continues to be moved for the staple operation at step S620.

If the staple mode is not the two-point binding mode at step S619, or if the staple operation is ended at step S620, step S621 is executed to allow the stapler 11 to be escaped.

At the next step S622, TG is moved to a bundle delivery position from FG, and after the end of the TG movement, the process transfers to step S609.

Figure 35:
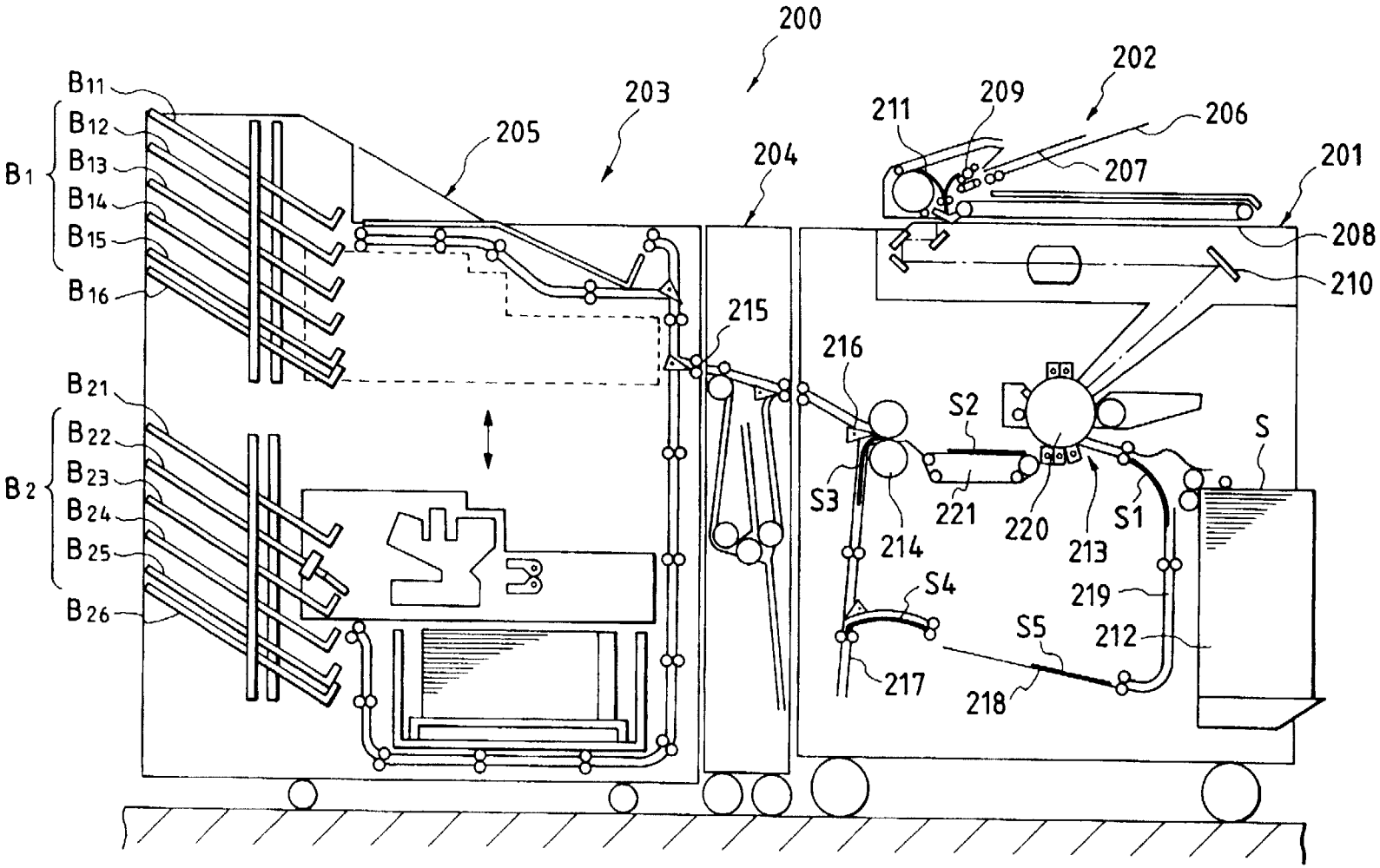
FIG. 35 is a view showing the flow of a sheet member in a both-side copy mode within a main unit of the copying machine of FIG. 1.
Figure 36:
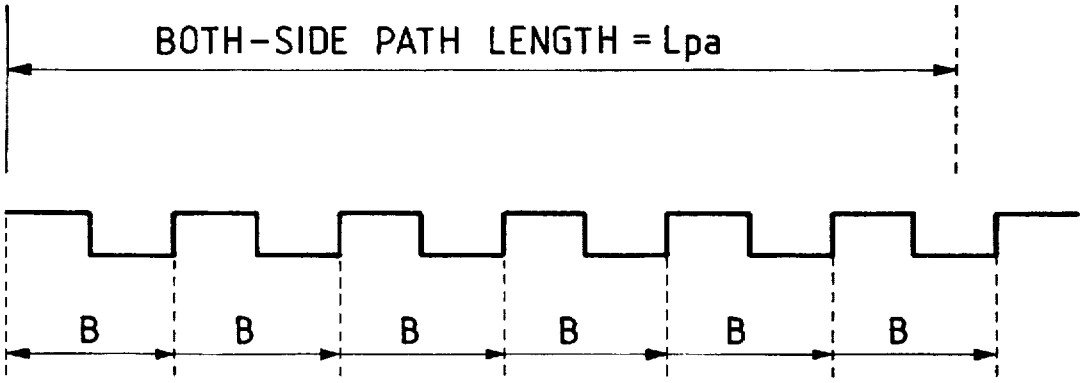
FIG. 36 is a chart showing the relation between the both-side path length within the main unit of the copying machine of FIG. 1 and the number of sheets that can be consecutively supplied into the main unit of the copying machine.

Next, setting the number of bins for each bin module B1, B2 for maintaining the productivity of the copying machine main unit in the both-side copy mode will be described below with reference to FIGS. 35 and 36. FIG. 35 is a view showing the flow of sheet member in the both-side copy mode within the copying machine main unit of FIG. 1, and FIG. 36 is a view showing the relation between both-side path length within the copying machine main unit and the number of sheets that can be consecutively fed into the copying machine main unit.

If the both-side copy mode is selected to output a predetermined number of sheets within the copying machine main unit, a plurality of sheets S are fed successively into the copying machine main unit 201, so that the image is formed on one face of the sheets S. Each of the sheets S having the image formed on one face is fed via a transport passage 221, a reverse path 217, an intermediate tray 218, and a resupply path 219 to the image forming unit 213, where the next image is formed on the opposite face of the sheets S.

Immediately after the image is formed on one face of all the sheets S, a plurality of sheets S remain on a both-side path leading from the image forming portion 213 through the transport passage 221, the reverse path 217, the intermediate tray 218, and the resupply path 219 to the image forming portion 213, as shown in FIG. 35. In this example, five sheets S1 to S5 exist, this sheet number "5" being the number of sheets S that can exist on the both-side path.

The sheet number n by which the sheets S can exist on the both-side path can be determined by both-side path length and the interval required for consecutively feeding the sheets S onto the both-side path.

Specifically, supposing that the both-side path length is Lpa, and the interval required for consecutively feeding the sheets S onto the both-side path is B, as shown in FIG. 36, the sheet number n by which the sheets S can exist on the both-side path can be obtained according to the following expression (1):

$$n=[Lpa/B] \quad (1)$$

Note that the relational expression [Lpa/B] as above is a function for obtaining the maximum integer not exceeding Lpa/B.

For example, as will be clear from FIG. 36, |Lpa/B| is equal to 5, so that the sheet number n by which the sheets S can exist on the both-side path is equal to 5.

For the sheet number n(=5) by which the sheets S can exist on the both-side path, the bin number m for each bin module B1, B2 is set to satisfy the following expression (2):

$$m \geqq n+1 \quad (2)$$

Hence, in this embodiment, with the sheet number by which the sheets S can exist on the both-side path equal to 5, and the bin number for each bin module B1, B2 equal to 6, when the maximum number of sheets S per job are consecutively exhausted from the copying machine main unit 201, the processing for each sheet S can be executed, without interrupting the operation of the copying machine main unit 201, thereby preventing reduced productivity of the copying machine main unit 201 in the both-side copy mode, caused by securing the processing time of exhausted sheet S.

Also, since the bin number for each bin module B1, B2 is set to the minimum integer satisfying the above expression (2), the larger size of the sheet member post-processor 203 can be suppressed, and the larger size of the electrophotographic copying machine 200 can be suppressed.

Supposing that the maximum number of processible sheets per job in the both-side copy mode is N, the bin number m for each bin module B1, B2 can be set based on the following expression (3):

$$m \geqq N \quad (3)$$

What is claimed is:

1. A sheet processing device which is mounted on an image forming apparatus having a both-side copy mode for forming an image on each side of a sheet member, comprising a bin module provided with a plurality of bins for accepting sheet members discharged from said image forming apparatus, and processing means for removing sheet members from said bin module and processing said sheet members, wherein, when the maximum number of sheet members continuously producible in said both-side copy mode of said image forming apparatus is N, and the number of bins is m, wherein m is set to satisfy the following relational expression:

$m \geqq N$.

2. A sheet processing device according to claim 1, wherein m is the maximum integer satisfying said relational expression.

3. A sheet processing device according to claim 1, wherein said processing means staples the sheet members.

4. A sheet processing device according to claim 1, further having a plurality of said bin module.

5. An image forming apparatus comprising image forming/processing means for selectively performing either a both-side copy mode for forming an image on each side of a sheet, or a single-side copy mode of forming an image on a single side of said sheet, discharge means for discharging a sheet member having said image formed thereon, and a sheet processing means for processing said sheet member discharged from said image forming apparatus, said sheet processing means comprising a bin module provided with a plurality of bins for accepting said sheet members discharged, and processing means for removing sheet members from said bin module and processing said sheet members, wherein, when the maximum number of sheet members continuously producible in said both-side copy mode is N, and the number of bins is m, wherein m is set to satisfy the following relational expression:

$m \geqq N$.

6. An image forming apparatus according to claim 5, wherein m is the minimum integer satisfying said relational expression.

7. An image forming apparatus according to claim 5, wherein said processing means staples the sheet members.

8. An image forming apparatus according to claim 5, further having a plurality of said bin module.

9. A sheet processing device which is mounted on an image forming apparatus having a both-side copy mode for forming an image on each side of a sheet member by feeding the sheet member into a both-side transport passage, and for processing the sheet members discharged from said image forming apparatus, comprising a bin module provided with a plurality of bins for accepting sheet members discharged from said image forming apparatus, and processing means for removing sheet members from said bin module and processing said sheet member, wherein, the maximum number of sheets that can be fed into said both-side transport passage of said image forming apparatus is n, and the number of bins is m, and wherein m is set to satisfy the following relational expression:

$m \geqq n+1$.

10. A sheet processing device according to claim 9, wherein m is the minimum integer satisfying said relational expression.

11. A sheet processing device according to claim 9, wherein said maximum number n of sheets that can be fed into said both-side transport passage is the maximum integer not exceeding the value of the length of said both-side transport passage divided by the sheet member interval required for consecutive feeding into said both-side transport passage.

12. A sheet processing device according to claim 9, wherein said processing means staples the sheet members.

13. A sheet processing device according to claim 9, further having a plurality of said bin module.

14. An image forming apparatus comprising image forming/processing means for selectively performing either a both-side copy mode for forming an image on each side of a sheet by feeding the sheet into a both-side transport passage, or a single-side copy mode of forming an image on a single side of said sheet, discharge means for discharging a sheet member having said image formed thereon, and a sheet processing means for processing said sheet member discharged, said sheet processing means comprising a bin module provided with a plurality of bins for accepting said sheet members discharged, and processing means for removing sheet members discharged from said bin module and processing said sheet members, wherein, the maximum number of sheets that can be fed into said both-side transport passage of said image forming/processing means is n, and the number of bins is m, and wherein m is set to satisfy the following relational expression:

$m \geqq n+1$.

15. An image forming apparatus according to claim 14, wherein m is the minimum integer satisfying said relational expression.

16. An image forming apparatus according to claim 14, wherein said processing means staples the sheet members.

17. An image forming apparatus according to claim 14, further having a plurality of said bin module.

18. A sheet processing device which is mounted on an image forming apparatus having a both-side copy mode for forming an image on each side of a sheet member, comprising a bin provided with a plurality of stacking means for accepting sheet members discharged from said image forming apparatus, and processing means for removing sheet members from said bin and processing said sheet members, wherein, when the maximum number of sheet members continuously producible in said both-side copy mode of said image forming apparatus is N, and the number of stacking means is m, wherein m is set to satisfy the following relational expression:

$m \geqq N$.

19. An image forming apparatus comprising image forming/processing means for selectively performing either a both-side copy mode for forming an image on each side of a sheet, or a single-side copy mode of forming an image on a single side of said sheet, discharge means for discharging a sheet member having said image formed thereon, and a sheet processing means for processing said sheet member discharged from said image forming apparatus, said sheet processing means comprising a bin provided with a plurality of stacking means for accepting said sheet members discharged, and processing means for removing sheet members from said bin and processing said sheet members, wherein, when the maximum number of sheet members continuously producible in said both-side copy mode is N, and the number of stacking means is m, wherein m is set to satisfy the following relational expression:

$m \geqq N$.

20. A sheet processing device which is mounted on an image forming apparatus having a both-side copy mode for forming an image on each side of a sheet member by feeding the sheet member into a both-side transport passage, and for processing the sheet members discharged from said image forming apparatus, comprising a bin provided with a plurality of stacking means for accepting sheet members discharged from said image forming apparatus, and processing means for removing sheet members from said bin and processing said sheet member, wherein, when the maximum number of sheets that can be fed into said both-side transport passage of said image forming apparatus is n, and the number of stacking means is m, wherein m is set to satisfy the following relational expression:

$m \geqq n+1$.

21. An image forming apparatus comprising image forming/processing means for selectively performing either a both-side copy mode for forming an image on each side of a sheet by feeding the sheet into a both-side transport passage, or a single-side copy mode of forming an image on a single side of said sheet, discharge means for discharging a sheet member having said image formed thereon, and a sheet processing means for processing said sheet member discharged, said sheet processing means comprising a bin provided with a plurality of stacking means for accepting said sheet members discharged, and processing means for removing sheet members discharged from said bin and processing said sheet members, wherein, the maximum number of sheets that can be fed into said both-side transport passage of said image forming/processing means is n, and the number of stacking means is m, wherein m is set to satisfy the following relational expression:

$m \geqq n+1$.

* * * * *

UNITED STATES PATENT AND TRADEMARK OFFICE

CERTIFICATE OF CORRECTION

PATENT NO. : 5,778,300

DATED : July 7, 1998

INVENTOR(S) : KOICHI MURAKAMI, ET AL.

It is certified that error appears in the above-identified patent and that said Letters Patent is hereby corrected as shown below:

On the title page,

Item [56] U.S. PATENT DOCUMENTS:

Insert --Re 35,087 11/95 Uto, et al.
4,928,941 05/90 Uto, et al.
5,417,417 05/95 Takehara, et al.
5,447,297 09/95 Murata, et al.
5,449,167 09/95 Takehara, et al.; and
5,568,247 10/96 Murata, et al.--.

Item [56] FOREIGN PATENT DOCUMENTS:

Insert --JP 4-138291 05/92 Japan;
JP 60-232372 11/85 Japan; and
JP 62-059002 03/87 Japan--.

COLUMN 1:

Line 5, "discharge," should read --discharged,--; and
Line 45, "can not" should read --cannot--.

COLUMN 5:

Line 9, "width 115" should read --width ℓ15.--; and
Line 14, "B1ℓ" should read --B11--.

UNITED STATES PATENT AND TRADEMARK OFFICE

CERTIFICATE OF CORRECTION

PATENT NO. : 5,778,300

DATED : July 7, 1998

INVENTOR(S) : KOICHI MURAKAMI, ET AL.

COLUMN 21:

Line 4, "can not" should read --cannot--; and
Line 50, "staple" should read --stapler--.

Signed and Sealed this

Twenty-third Day of March, 1999

*Attest:*

Q. TODD DICKINSON

*Attesting Officer*

*Acting Commissioner of Patents and Trademarks*